US007419775B2

(12) United States Patent
Ito et al.

(10) Patent No.: US 7,419,775 B2
(45) Date of Patent: Sep. 2, 2008

(54) MICRO-PARTICLE DISPERSION HAVING HYDROPHOBIC PROTECTIVE COLLOID AND METHOD OF MANUFACTURE THEREOF, PHOTOSENSITIVE EMULSION AND METHOD OF MANUFACTURING THEREOF, AND SILVER SALT PHOTOHERMOGRAPHIC DRY IMAGING MATERIAL UTILIZING THE SAME

(75) Inventors: Hiroto Ito, Hachioji (JP); Kazuhito Ihara, Hachioji (JP)

(73) Assignee: Konica Minolta Medical & Graphic, Inc., Tokyo (JP)

( * ) Notice: Subject to any disclaimer, the term of this patent is extended or adjusted under 35 U.S.C. 154(b) by 226 days.

(21) Appl. No.: 11/268,638

(22) Filed: Nov. 8, 2005

(65) Prior Publication Data

US 2006/0099539 A1 May 11, 2006

(30) Foreign Application Priority Data

Nov. 11, 2004 (JP) ..... 2004-327456
Apr. 15, 2005 (JP) ..... 2005-118097

(51) Int. Cl.
*G03C 1/00* (2006.01)
*G03C 1/005* (2006.01)
*G03C 1/494* (2006.01)

(52) U.S. Cl. ..... 430/617; 430/618; 430/619; 430/620; 430/964; 430/935; 430/631; 430/634; 430/635; 430/642; 430/546

(58) Field of Classification Search ..... 430/617–620, 430/631, 634–635, 935, 546, 642, 964
See application file for complete search history.

(56) References Cited

U.S. PATENT DOCUMENTS 7,018,770 B1 * 3/2006 Dickerson et al. ..... 430/139
7,129,031 B2 * 10/2006 Loccufier et al. ..... 430/502
7,138,223 B2 * 11/2006 Inoue ..... 430/523

* cited by examiner

*Primary Examiner*—Geraldina Visconti
(74) *Attorney, Agent, or Firm*—Finnegan, Henderson, Farabow, Garrett & Dunner, L.L.P.

(57) ABSTRACT

A method of manufacturing a micro-particle dispersion having a hydrophobic protective colloid comprising the steps of: (a) dispensing micro-particles in a hydrophilic dispersant to form a hydrophilic micro-particle dispersion having the hydrophilic dispersant as a protective colloid, and (b) adding a dispersant to the hydrophilic micro-particle dispersion, the dispersant having a functional group capable of ion bonding with a hydrophilic group of the hydrophilic dispersant.

4 Claims, No Drawings

MICRO-PARTICLE DISPERSION HAVING HYDROPHOBIC PROTECTIVE COLLOID AND METHOD OF MANUFACTURE THEREOF, PHOTOSENSITIVE EMULSION AND METHOD OF MANUFACTURING THEREOF, AND SILVER SALT PHOTOHERMOGRAPHIC DRY IMAGING MATERIAL UTILIZING THE SAME

This application is based on Japanese Patent Application Nos. 2004-327456, filed on Nov. 11, 2004, and 2005-118097, filed on Apr. 15, 2005, in Japanese Patent Office, the entire content of which is hereby incorporated by reference.

FIELD OF THE INVENTION

The present invention relates to a micro-particle dispersion having a hydrophobic protective colloid and a method of manufacturing it, a photosensitive emulsion utilized in a silver salt photothermographic dry imaging material and a method of manufacturing thereof, and a silver salt photothermographic dry imaging material utilizing the same.

BACKGROUND

At present, nano-order micro-particles are greatly demanded in a variety of industrial fields, and dispersion technologies of the nano micro-particles are regarded as critical. Among them, a major technical hurdle to a stable dispersion technology of inorganic micro-particles in a solvent-based resin has surfaced. That is, because the surface of inorganic micro-particles is generally hydrophilic, it is generally said that producing a solvent-based dispersion is quite difficult. To overcome the above problem, for example, to disperse hydrophilic inorganic micro-particles in a solvent, a dispersion technique in which a hydrophobic dispersant is supplied as a protective colloid via a chemical bond on the micro-particle surface, is disclosed, for example, Patent Document 1. However, in Patent Document 1, not mentioned nor at all indicated on a solvent-based micro-particle dispersion technology of applying a hydrophobic dispersant compared to hydrophilic protective colloid particles, which are dispersible in a water system.

Further, as a dispersion method in a hydrophilic-lipophilic dispersion system, a method, in which thermosensitive polymers capable of reversibly varying hydrophilicity/hydrophobicity by making a transition temperature of a dispersant polymer as a threshold value, which is disclosed, for example, Patent Document 2. However, since it the method disclosed in Patent Document 2, hydrophilicity/hydrophobicity of a dispersant polymer is reversible by temperature, it is problematic that a significant limitation will result with respect to modification variations in a water system and a solvent-system, respectively.

That is, this invention is characterized in that nano-order micro-particles are dispersible in both a water system and a solvent system. To enable micro-particle modification in a water system, and separately in a solvent system, in each liquid phase is a quite new technique, and can be said to be a technique having a great advantage and promising potential.

On the other hand, in recent years, in the medical and printing plate making fields, a decrease in processing effluent, resulting from wet type processing of image forming materials, has been highly demanded, from the viewpoint of environmental protection as well as storage space conservation. Accordingly, technologies related to a silver salt photothermographic dry imaging material (hereinafter, also referred to as a photothermographic material or a photosensitive material) to be applied in photographic technology, which can perform efficient exposure such as a laser imager and a laser image setter as well as a black colored image formation having high resolution and sharpness, have been required.

As technologies concerning the above photothermographic material, such as described for example in U.S. Pat. Nos. 3,152,904 and 3,487,075, by D. Morgan and B. Shely, or in "Dry Silver Photographic Materials" (Handbook of Imaging Materials, p. 48, 1991, published by Marcel Dekker Inc.), a silver salt photothermographic dry imaging material, which contains an organic silver salt, a photosensitive silver halide emulsion and a reducing agent on a support, is prior art. This silver salt photothermographic dry imaging material has the advantage of providing operators with simpler handling and minimal environmental disturbance since no solution type processing chemicals are at all employed.

These silver salt photothermographic dry imaging materials are characterized by utilizing photosensitive silver halide grains as a optical sensor and organic silver salt as a supply source of silver ion, and performing image formation, by use of an integral reducing agent, by thermal developing generally at 80-140° C., without fixing.

In silver salt photothermographic dry imaging materials such as in particularly described above, in a silver salt photothermographic dry imaging material prepared by a solvent type coating method, a silver halide emulsion utilized as a photoreceptor often utilizes a hydrophilic dispersant such as gelatin as a protective colloid, often resulting in a problem of causing grain aggregation or unnecessary grain growth (also referred to as ripening) when silver halide grains are exposed to an organic solvent. However, since there are many advantageous conventional technologies due to utilization of gelatin as a protective colloid, such as a silver halide grain forming technology using a water medium, a chemical sensitization technology of silver halide grains by a water-soluble sensitizer, a storage technology of silver halide grains using a gelation of gelatin, problems such as aggregation of silver halide grains in a solvent system had to be compromised to some extent.

Heretofore, as conventional counter-measures to grain aggregation, silver halide grains are added during formation of organic silver salt grains, which are contained in a silver salt photothermographic dry imaging material, to utilize a long-chain fatty acid as a dispersant for silver halide grains, resulting in reduced aggregation. However, dispersibility of silver halide grains is not sufficient, as well as fogging, which is an important characteristic in a silver salt photothermographic dry imaging material, because of a mixed system with organic silver salts, that is, it is the present state of the art which problems have not yet been overcome.

[Patent Document 1] Unexamined Japanese Patent Application Publication No. (hereinafter, referred to as JP-A) 5-111631

[Patent Document 2] JP-A 7-276792

SUMMARY OF THE INVENTION

Problems to be Solved

This invention has been achieved in response to the above problems, and an object is to provide a micro-particle dispersion having a hydrophobic protective colloid while retaining the technical advantage of conventionally utilized a dispersible hydrophilic micro-particle dispersion, employing a hydrophilic dispersant such as gelatin as a protective colloid. Another object of this invention is to provide a photosensitive emulsion, which has a dispersibility equal to that of a conventional hydrophilic micro-particle dispersion; grain aggregation of in a solvent which is depressed by addition of a dispersant, provided with a functional group capable of forming an ionic bond with a hydrophilic group of a hydrophilic dispersant, to prepare a micro-particle dispersion having a hydrophobic protective colloid; and further which results in low minimum density, high image density, high sensitivity as well as superior storage stability due to more uniform dispersion distribution of silver halide grains with fatty acid silver salt grains and smaller grain size of fatty acid silver salt grains; a preparation method thereof; and a silver salt photothermographic dry imaging material utilizing the same.

Means to Solve the Problems

The above objects can be achieved by the following constitutions.

Item 1. A method of manufacturing a micro-particle dispersion having a hydrophobic protective colloid comprising the steps of:

(a) dispersing micro-particles in a hydrophilic dispersant to form a hydrophilic micro-particle dispersion having a hydrophilic dispersant as a protective colloid, and (b) adding a dispersant to the hydrophilic micro-particle dispersion, the dispersant having a functional group capable of ion bonding with a hydrophilic group of the hydrophilic dispersant.

Item 2. A micro-particle dispersion having a hydrophobic protective colloid manufactured by the method of Item 1.

Item 3. The micro-particle dispersion having a hydrophobic protective colloid of. Item 2, wherein an average sphere equivalent particle diameter of the micro-particles is 1 nm-1, 000 nm.

Item 4. The micro-particle dispersion having a hydrophobic protective colloid of Item 2 or 3, wherein the functional group of the dispersant used in step (b) is a carboxyl group or an amide group.

Item 5. The micro-particle dispersion having a hydrophobic protective colloid of any one of Items 2-4, wherein a molecular weight of the dispersant used in step (b) is 10,000-100,000.

Item 6. The micro-particle dispersion having a hydrophobic protective colloid of Item 4 or 5 further dispersed in methyl ethyl ketone.

Item 7. The micro-particle dispersion having a hydrophobic protective colloid manufactured by the method of Item 6.

Item 8. The micro-particle dispersion having a hydrophobic protective colloid of any one of Items 2-5 and 7, wherein the micro-particles are silver halide grains.

Item 9. A photothermographic material comprising the micro-particle dispersion having a hydrophobic protective colloid of any one of Items 2-5, 7 and 8.

Item 10. A photothermographic material comprising a support having thereon a layer containing a photosensitive emulsion, photo-insensitive organic silver salt grains and a binder, wherein the photosensitive emulsion comprises the micro-particle dispersion having a hydrophobic protective colloid of any one of Items 2-5, 7 and 8.

Item 11. The photothermographic material of Item 10, wherein the micro-particle dispersion having a hydrophobic protective colloid of any one of claims 2-5, 7 and 8 is added after formation of the photo-insensitive silver halide grains.

Item 12. A photosensitive emulsion prepared by mixing:

(a) a photosensitive silver halide grain dispersion in which silver halide grains are dispersed in an organic solvent having a water content of not more than 10%, and (b) a photo-insensitive organic silver salt grain dispersion in which photo-insensitive organic silver salt grains are dispersed in an organic solvent having a water content of not more than 10%.

Item 13. The photosensitive emulsion of Item 12, wherein the photosensitive silver halide grain dispersion contains a synthetic polymer as a protective colloid for dispersion.

Item 14. The photosensitive emulsion of Item 12, wherein the photosensitive silver halide grain dispersion contains a synthetic polymer and a natural polymer as a protective colloid for dispersion.

Item 15. The photosensitive emulsion of Item 13 or 14, wherein the synthetic polymer contains an amide group as a functional group.

Item 16. The photosensitive emulsion of Item 14, wherein the natural polymer contains a carboxyl group as a functional group.

Item 17. The photosensitive emulsion of any one of Items 12-16, wherein the photo-insensitive organic silver salt grains exhibit a silver behenate content of not less than 50 mol % and not more than 100 mol %.

Item 18. The photosensitive emulsion of any one of Items 12-17, wherein the photo-insensitive organic silver salt grains exhibit an average sphere equivalent diameter of not less than 0.05 μm and not more than 0.50 μm, and a standard deviation indicating a grain diameter distribution of not more than 0.3.

Item 19. The photosensitive emulsion of any one of Items 12-18, wherein the photo-insensitive organic silver salt grains are formed with a simultaneous measuring and mixing method of an aqueous solution of a fatty acid alkali metal salt, or an aqueous dispersion thereof, and a silver nitrate aqueous solution, as well as being formed in the absence of the photosensitive silver halide grains.

Item 20. The photosensitive emulsion of any one of Items 12-18, wherein the photo-insensitive organic silver salt grains are formed by simultaneous measuring and mixing method of an aqueous solution of a fatty acid alkali metal salt or an aqueous dispersion thereof, and a silver nitrate aqueous solution, and the simultaneous measuring and mixing method is conducted during transfer of the solutions, as well as being formed in the absence of the photosensitive silver halide grains.

Item 21. A silver salt photothermographic material comprising a support having thereon the photosensitive emulsion of any one of Items 12-20, a silver ion reducing agent and a binder.

Item 22. A method of manufacturing a photosensitive emulsion comprising the step of mixing:

(a) a photosensitive silver halide grain dispersion in which silver halide grains are dispersed in an organic solvent having a water content of not more than 10%, and (b) a photo-insensitive organic silver salt grain dispersion in which photo-insensitive organic silver salt grains are dispersed in an organic solvent having a water content of not more than 10%.

Item 23. The method of manufacturing the photosensitive emulsion of Item 22, wherein the photosensitive silver halide grain dispersion contains a synthetic polymer as a protective colloid for dispersion.

Item 24. The method of manufacturing the photosensitive emulsion of Item 22, wherein the photosensitive silver halide grain dispersion contains a synthetic polymer and a natural polymer as protective colloids for dispersion.

Item 25. The method of manufacturing the photosensitive emulsion of Item 22 or 23, wherein the synthetic polymer contains an amide group as a functional group.

Item 26. The method of manufacturing the photosensitive emulsion of Item 24, wherein the natural polymer contains a carboxyl group as a functional group.

Item 27. The method of manufacturing the photosensitive emulsion of any one of Items 22-26, wherein the photo-insensitive organic silver salt grains exhibits a silver behenate content of not less than 50 mol % and not more than 100 mol %.

Item 28. The method of manufacturing the photosensitive emulsion of any one of Items 22-27, wherein the photo-insensitive organic silver salt grains exhibits an average sphere equivalent diameter of not less than 0.05 μm and not more than 0.50 μm, and a standard deviation indicating a grain diameter distribution of not more than 0.3.

Item 29. The method of manufacturing the photosensitive emulsion of any one of Items 22-28, wherein the photo-insensitive organic silver salt grains are formed with a simultaneous measuring and mixing method of an aqueous solution of a fatty acid alkali metal salt or an aqueous dispersion thereof, and a silver nitrate aqueous solution, as well as being formed in the absence of the photosensitive silver halide grains.

Item 30. The method of manufacturing the photosensitive emulsion of any one of Items 22-28, wherein the photo-insensitive organic silver salt grains are formed with a simultaneous measuring and mixing method of an aqueous solution of a fatty acid alkali metal salt or an aqueous dispersion thereof, and a silver nitrate aqueous solution, and the simultaneous measuring and mixing method is conducted during transportation of the solutions, as well as being formed in the absence of the photosensitive silver halide grains.

Item 31. The silver salt photothermographic material comprising a support having thereon the photosensitive emulsion prepared by the method of manufacturing of any one of Items 22-30, a silver ion reducing agent and a binder.

EFFECTS OF THE INVENTION

This invention can provide a thermally developable photosensitive material which exhibits low fog, high covering power (CP) as well as high maximum density and superior humidity resistance by preparing a micro-particle dispersion having a hydrophobic protective colloid.

This invention can also provide a photosensitive emulsion; which-has a dispersibility equal to that of a conventional hydrophilic micro-particle dispersion, grain aggregation of which in a solvent is depressed by addition of a dispersant, which is provided with a functional group capable of forming an ionic bond with a hydrophilic group of a hydrophilic dispersant, to prepare a micro-particle dispersion having a hydrophobic protective colloid; and further which is provided with a low fog, high image density, high sensitivity as well as superior storage stability due to uniform dispersion distribution of silver halide grains and fatty acid silver salt grains and smaller grain size of fatty acid silver salt grains; and a preparation method thereof and a silver salt photothermographic dry imaging material utilizing the same.

That is, according to this invention, sufficient dispersibility and stability can be achieved even when organic silver salt and silver halide grains are separately added in an organic solvent system, because dispersibility of silver halide grains in a solvent becomes extremely excellent. Silver halide dispersion emulsion utilizing gelatin as a protective colloid may cause aggregation in a solvent to make separate addition of organic silver salt and silver halide grains impossible. Improvement of the characteristics has been achieved by addition of a dispersant which is provided with a functional group capable of forming an ionic bond with a hydrophilic group of a hydrophilic dispersant to prepare a micro-particle dispersion having a hydrophobic protective colloid. As a result, a silver salt photothermographic dry imaging material in which aggregation or grain growth (ripening) of silver halide grains was depressed and which is provided with low fog and high covering power, can be realized. Further, it has been surprisingly found that the moisture resistance is improved due to a colloid component in the neighborhood of silver halide grains having been made hydrophobic. Further, the distribution of dispersed grains of silver halide grains and fatty acid silver salt grains have been made uniform, to make significantly small size of fatty acid silver salt grains, as a result, realized can be a silver salt photothermographic dry imaging material provided with low fog and high image density as well as rapid processing adaptability.

DETAILED DESCRIPTION OF THE INVENTION

In the following paragraph, the most preferable embodiment to practice this invention will be detailed.

The inventors of this invention, as a result of extensive study in view of the above problems, have found that aggregation in an organic solvent is depressed and a photosensitive emulsion provided with low fog and high image density can be realized by uniform dispersion distribution of silver halide grains and fatty acid silver salt grains and small grain size of fatty acid silver salt, by employing a photosensitive emulsion which is prepared by mixing a photosensitive silver halide grain dispersion, in which photosensitive silver halide grains are dispersed in an organic solvent having a water content of not more than 10%, into a photo-insensitive organic silver salt grain dispersion, in which photo-insensitive organic silver salt grains are dispersed in an organic solvent having a water content of not more than 10%.

In the following paragraphs, this invention will be detailed. "A hydrophilic dispersant" in this invention will now be explained, however, this invention is not limited thereto.

A hydrophilic dispersant of this invention is preferably gelatin utilized in ordinary photography. With respect to gelatin utilized in ordinary photography, for details, for example, "Basic of Photographic Technologies/Silver Salt Photography" edited by Japanese Society of Photography (published by Corona Co., pp. 122-124) can be referred to.

Gelatin is produced from collagen which is a primary component of connective tissue of animals; and raw materials of photographic gelatin include such as beef bone, ox-hide and pig skin, however, beef bone and ox-hide are generally utilized. Further, there are two types of methods, an acid process method and a liming process method, as a processing method of collagen, however, a liming process method is generally utilized for photographic gelatin and it is also preferable to employ a liming process method for gelatin according to this invention. As an example, in the case of manufacturing photographic gelatin from beef bone by a liming process method, generally performed are processes of deashing, liming process, extraction, filtration, gelation and drying. After dried beef bone is immersed in dilute hydrochloric acid solution for 4-8 days to be deashed, via washing with water and neutralization, cow-hide and beef bone are immersed in saturated lime water for 2-3 months to eliminate such as keratin, further via washing with water and neutralization, extraction is carried out with hot water of 50-60° C. for 6-8 hours (the first extraction); then the second and third extractions are performed with addition of hot water having a higher temperature by 5-10° C. After extraction followed by filtering process, concentration under reduced pressure at generally not higher than 60° C. is performed, followed by cooling, gelation and then drying at approximately 25° C., resulting in preparation of final gelatin.

Gelatin utilized in this invention preferably utilizes hard bone of beef bone as a raw material in the above manufacturing method. The extraction temperature of gelatin is set to not higher than 60° C., and after filtering process, the both processes by use of positive ion and negative ion exchange resins are performed to prepare the gelatin. The extraction temperature of gelatin is preferably not higher than 55° C. and more preferably not higher than 40° C.

A deionization process may be performed at any stage after the gelatin extraction process, however, is preferably performed after the filtration process.

Ion exchange resin includes those provided with a —H type and a —Na type as a positive ion exchange group, and a —OH type and a —Cl type as a negative ion exchange group, however, those provided with a —H type as a positive ion exchange group, and a —OH type as a negative ion exchange group are preferred. As processing conditions, it is preferable to set the using amount and processing time of ion exchange resin so as to make a pH value of a gelatin solution of approximately 4.5-5.3. Further, to previously perform a processing by positive ion exchange resin is preferred.

A gelatin solution having been ion exchange processed may be subjected to an adjustment of the pH value by use of an ordinary pH adjusting agent, however, is preferably utilized at a pH of the isoelectric point as it is without adjustment.

"A dispersant having a functional group capable of ion bonding with a hydrophilic group of a hydrophilic dispersant" in this invention will now be explained. In this invention, as "a dispersant having a functional group capable of ion bonding with a hydrophilic group of a hydrophilic dispersant", any of natural resin, polymer and copolymer; and synthetic resin, polymer or copolymer can be utilized. For example, such as gelatins and rubbers which have been modified so as to belong to the category of this invention can be utilized. Further, in the case of the hydrophilic group of a hydrophilic dispersant being a carboxyl group, a dispersant, which is provided with an amide group as a functional group capable of forming an ionic bond, is preferred. On the other hand, in the case of the hydrophilic group of a hydrophilic dispersant being an amino group, a dispersant, which is provided with a carboxyl group as a functional group capable of ion bonding, is preferred. In the following paragraphs, specific examples will be shown, however, this invention is not limited thereto.

Polymers belonging to the following classification can be utilized by introducing a functional group to fit this invention. Listed are poly(vinyl alcohol)s, hydroxyethyl celluloses, cellulose acetates, cellulose acetate butyrates, poly(vinyl pyrrolidone)s, casein, starch, poly(acrylic acid and acrylic acid ester)s, poly)methylmethacrylic acid and methacrylic acid ester)s, poly(vinyl chloride)s, poly(methacrylic acid)s, styrene-maleic acid anhydride copolymers, poly(vinyl acetal)s (such as poly(vinyl formal) and poly(vinyl butyral)), poly (ester)s, poly(urethane)s, phenox resin, poly(vinilidene chloride)s, poly(epoxide)s, poly(carbonate)s, poly(vinyl acetate)s, poly(olefin)s, cellulose esters and poly(amide)s. Copolymers comprising a few types of these polymers may be also utilized, however, in particular, polymers, in which acrylic acid, methacrylic acid and esters thereof are copolymerized, are preferable.

With respect to solubility, so-called block polymer and comb-structure (graft) polymer are more suitable than straight-chain polymer. In particular, comb-structure polymer is preferred. To manufacture comb-structure polymer, various methods can be utilized, however, monomer, which can introduce a side chain having a molecular weight of not less than 200 at the comb portion (side chain), is preferably utilized. In particular, ethylenic unsaturated monomer provided with a polyoxyalkylene group such as ethylene oxide and propylene oxide is preferably utilized.

As ethylenic unsaturated monomer provided with polyoxyalkylene group, those provided with polyoxyethylene groups represented by the following general formula are specifically preferred.

$$-(EO)_l-(PO)_m-(TO)_n-R$$

wherein, E represents an ethylene group, P represents a propylene group, T represents a butylenes group, and R represents a substituent. Butylene groups include such as a tetramethylene group and an isobutylene group. 1 represents an integer of 1-300, m represents 0 or an integer of 1-60 and n represents 0 or an integer of 1-40. Preferably 1 is 1-200, m is 0-30 and n is 0-20. However, 1, m and n satisfy $1+m+n \geqq 2$.

Substituents represented by R represent such as an alkyl group, an aryl group and a heterocyclic group; including groups of such as methyl, ethyl, propyl, butyl, hexyl, octyl and dodecyl as an alkyl group; including groups of such as phenyl and naphthyl as an aryl group; and including groups of such as thienyl and pyridyl. These groups may be further substituted by a halogen atom, an alkoxy group (such as a methoxy group, an ethoxy group and a butoxy group), an alkylthio group (such as a methylthio group and a butylthio group), an acyl group (such as an acetyl group and a benzoyl group), an alkaneamido group (such as an acetoamido group and a propyoneamido group) and an arylamido group (such as a benzoylamido group). Further, these substituents may be further substituted by these substituents.

Polyoxyalkylene groups represented by the aforesaid general formula can be introduced in polymer by utilizing ethylenic unsaturated monomer provided with these polyoxyalkylene groups. Ethylenic unsaturated monomer provided with these groups include such as (polyoxyalkylene) acrylate and methacrylate, which can be produced by reacting hydroxypoly(oxyalkylene) materials available on the market, such as "Pluronic (produced by Asahi Denka Kogyo Co., Ltd.)", Adekapolyether (produced by Asahi Denka Co., Ltd.), Carbowax (produced by Glico Products Co.), Toriton (produced by Rohm and Haas Co.) and P. E. G (produced by Dai-ichi Kogyo Seiyaku Co., Ltd.), with such as acrylic acid, methacrylic acid, acrylchloride, methacrylchloride or acrylic acid anhydride by means of a method well known in the art. In addition to this, such as poly(oxyalkylene)diacrylate prepared by a commonly known method can also be utilized.

Further, monomer available on the market includes such as Blemmer PE-90, Blemmer PE-20, Blemmer PE-350, Blemmer AE-90, Blemmer AE-200, Blemmer AE-400, Blemmer PP-1000, Blemmer PP-500, Blemmer PP-800, Blemmer AP-150, Blemmer AP-400, Blemmer AP-550, Blemmer AP-800, Blemmer 50PEP-300, Blemmer 70PEP-350B, Blemmer AEP Series, Blemmer 55PET-400, Blemmer 30PET-800, Blemmer 55PET-800, Blemmer AET series, Blemmer 30PPT-800, Blemmer 50PPT-800, Blemmer 70PPT-800, Blemmer ATP Series, Blemmer 10PPB-500B and Blemmer 10APB-500B as hydroxyl group end polyalkyleneglycol mono(meth)acrylate produced by NOF Corp. Similarly, listed are alkyl end polyalkyleneglycol mono (meth)acrylates, produced by NOF Corp., such as Blemmer PME-100, Blemmer PME-200, Blemmer PME-400, Blemmer PME-1000, Blemmer PME-4000, Blemmer AME-400, Blemmer 50POEP-800B, Blemmer-50AOEP-800B, Blemmer PLE-200, Blemmer ALE-200, Blemmer ALE-800, Blemmer PSE-400, Blemmer PSE-1300, Blemmer ASEP Series, Blemmer PKEP Series, Blemmer AKEP Series, Blemmer ANE-300, Blemmer ANE-1300, Blemmer PNEP Series, Blemmer PNPE series, Blemmer 43ANEP-500 and Blemmer 70ANEP-550; and further listed are such as Light-Ester MC, Light-Ester 130MA, Light-Ester 041MA, Light-Acrylate BO-A, Light-Acrylate EC-A, Light-Acrylate MTG-A, Light-Acrylate 130A, Light-Acrylate DPM-A, Light-Acrylate P-200A, Light-Acrylate NP-4EA and Light-Acrylate NP-8EA, all produced by Kyoeisha Chemical Co., Ltd.

In this invention, graft polymer, which utilizes so-called macromer, can be also employed. This is described in, for example, "New Polymer Experiments 2, Synthesis and Reaction of Polymer", edited by Polymer Society, published by Kyoritsu Shuppan Co., Ltd., 1995. This is also detailed in "Chemistry and Industry of Macro-monomer" by Yuya Yamashita, published by I. P. C., 1989. The useful molecular weight of macromonomer is in a range of 10,000-100,000, preferably in a range of 10,000-50,000 and specifically preferably in a range of 10,000-20,000. The effects cannot be achieved with a molecular weight of not more than 10,000, while polymerization capability with copolymerizing monomer to form the primary chain becomes poor with mot less than 100,000. Specifically, such as AA-6, AS-6S and AN-6S, produced by Toagosei Co., Ltd., can be utilized.

Herein, this invention is naturally not limited by specific examples described above. Ethylenic unsaturated monomer provided with a polyoxyalkylene group may be utilized alone or in combination of at least two types.

Monomer to be reacted with the above monomer specifically includes the following monomeric substances.

Listed are:

acrylic acid esters: such as methyl acrylate, ethyl acrylate, propyl acrylate, chloroethyl acrylate, 2-hydroxyethyl acrylate, trimethylolpropane monoacrylate, benzyl acrylate, methoxybenzyl acrylate, furfuryl acrylate and tetrahydrofurfuryl acrylate;

methacrylic acid ester: such as methyl methacrylate, ethyl methacrylate, propyl methacrylate, chloroethyl methacrylate, 2-hydroxyethyl methacrylate, trimethylolpropane monomethacrylate, benzyl methacrylate, methoxybenzyl methacrylate, furfuryl methacrylate and tetrahydrofurfuryl methacrylate;

acrylamides: such as acrylamide, N-alkylacrylamide (alkyl groups are those having a carbon number of 1-3, such as a methyl group, an ethyl group and a propyl group), N,N-dialkyl acrylamide, N-hydroxyethyl-N-methylacrylamide and N-2-acetoamidoethyl-N-acetyl acrylamide; and methoxymethyl acrylamide and butoxymethyl acrylamide as alkyloxyacrylamide;

methacrylamides: such as methacrylamide, N-methalkylacrylamide, N-hydroxyethyl-N-methylmethacrylamide, N-2-acetoamidoethyl-N-acetyl methacrylamide, methoxymethyl methacrylamide and butoxymethyl methacrylamide;

allyl compounds: such as allyl esters (such as allylacetate, allylcaproate, allylcaprylate, allyllaurate, allylpalmitate, allylstearate, allylbenzoate; allylacetoacetate and allyllactate) and alllyloxy ethanol, vinyl ethers: such as alkyl vinyl ether (such as hexyl vinyl ether, octyl vinyl ether, decyl vinyl ether, ethylhexyl vinyl ether, methoxyethyl vinyl ether, ethoxyethyl vinyl ether, chloroethyl vinyl ether, 1-methyl-2,2-dimethylpropyl vinyl ether, 2-ethylbutyl vinyl ether, hydroxyethyl vinyl ether, diethyleneglycol vinyl ether, dimethylaminoethyl vinyl ether, diethylaminoethyl vinyl ether, butylaminoethyl vinyl ether, benzyl vinyl ether and tetrahydrofurfryl vinyl ether);

vinyl esters: such as vinyl butyrate, vinyl isobutyrate, vinyl trimethylacetate, vinyl diethylacetate, vinyl valerate, vinyl caproate, vinyl chloroacetate, vinyl dichloroacetate, vinyl methoxyacetate, vinyl buthoxyacetate, vinyl lactate, vinyl-β-phenylbutylate and vinyl cyclohexylcarboxylate;

dialkyl itaconates: such as dimethyl itaconate, diethyl itaconate and dibutyl itaconate; dialkyl esters or monoalkyl esters of fumaric acid: such as dimethyl fumarate; in addition to these, listed are such as crotonic acid, itaconic acid, acrylonitrile, methacrylonitrile, maleylonitrile and styrene.

In the case of introducing an amido group, a straight chain or branched alkyl group, an aromatic group having a carbon number of 4-22 or a heterocyclic group of not less than 5-membered, monomer containing these functional group, among the above monomers or other monomers, may be selected. For example, to introduce a heterocyclic group of not less than 5-membered, 1-vinyl imidazole or derivatives thereof can be utilized. Further, after an isocyanate group or an epoxy group is introduced in polymer in advance, various functional groups may be introduced in said polymer by being reacted with alcohols and amines containing a straight chain or side chain alkyl group, an aromatic group, or a heterocyclic group of not less than 5-membered. To introduce an isocyanate group or an epoxy group, KarenzMOI (produced by Showa Denko Co., Ltd.) or Blemmer G (produced by NOF Corp.) can be utilized. It is also preferred in this invention to introduce a urethane bond.

As a polymerization initiator, azo type polymer polymerization initiators and organic peroxides can be utilized. Azo type polymer polymerization initiators include such as ABN-R (2,2'-azobisbutyronitrile), ABN-V (2,2'-azobis(2,4-dimethylvaleronitrile)) and ABN-E (2,2'-azobis(2-dimethylbutyronitrile), produced by Nippon Hydrazine Industry Co., Ltd. Further, organic peroxides include such as benzoyl peroxide, dimethyl ethyl ketone peroxide, lauryl peroxide; and Pertetra A, Perhexa HC, Perhexa TMH, Perhexa C, Perhexa V, Perhexa 22, Perhexa MC, Perbutyl H, Percumyl H, Percumyl P, Permentha H, Perocta H, Perbutyl C, Perbutyl D, Perhexyl D, Peroyl IB, Peroyl 355, Peroyl L, Peroyl S, Peroyl SA, Nyper BW, Nyper BMT-K40, Nyper BMT-T40, Nyper BMT-M, Peroyl IPP, Peroyl NPP, Peroyl TCP, Peroyl EEP, Peroyl MBP, Peroyl OPP, Peroyl SBP, Percumyl ND, Perocta ND, Percyclo ND, Perhexyl ND, Perbutyl ND, Perhexyl PV, Perhexa 250, Perocta O, perhexyl O, Perbutyl O, Perbutyl IB, Perbutyl L, Perbutyl 355, Perhexyl I, Perbutyl I, Perbutyl E, Perhexa 25Z, Perhexa 25MT, Perbutyl A, Perhexyl Z, Perbutyl ZT and Perbutyl Z (these produced by NOF Corp.)

Further, as a polymerization inhibitor of this invention, utilized are quinone type inhibitors, which include hydroquinone and p-methoxyphenol. Further listed are such as phenothiazine,. Methoquinone, Nonflex alba, MH (methyl hydroquinone), TBH (tert-butyl hydroquinone), PBQ (p-benzoquinone), toluquinone, TBQ (ter-butyl-p-benzoquinone) and 2,5-diphenyl-p-benzoquinone, all produced by Seiko Chemical Co., Ltd.

In this invention, the isoelectric point of polymer is preferably not more than pH 6. It is because, by utilizing polymer having a high isoelectric point, decomposition of silver halide grains will be accelerated resulting in bad influence to photographic capabilities when silver halide grains are desalted by means of an aggregation precipitation method as described later. Further, it is not preferable with respect to fog because pH has to be increased for better dispersion when silver halide grains are dispersed in a solvent. Further, measurement of an isbelectric point of polymer can be performed, for example, by an isoelectric electrophoresis, or by measuring pH after passing 1% aqueous solution of polymer has been passed through a mixed bed column of cationic and anionic exchange resin.

To lower an isoelectric point of polymer, various types of acidic groups can be introduced. For example, a carboxylic acid group and a sulfonic acid group are listed. To introduce a carboxylic acid group, in addition to. employing monomers such as acrylic acid and methacrylic acid, it can be also prepared by partly hydrolyzing polymer containing methylmethacrylate. To introduce a sulfonic acid group, in addition to employing monomers such as styrene sulfonate and 2-acrylamido-2-methylpropane sulfonate, it can be also introduced after polymer formation by various types of sulfation methods. It is specifically preferred to utilize carboxylic acid because of providing relatively high solubility in a solvent in a state of not being neutralized and enabling to change the property to be water-soluble in a state of neutralization or half neutralization. The neutralization can also be performed by use of sodium or potassium salt, as well as by ammonia or organic salts such as monoethanol amine, diethanol amine and triethanol amine. Also can be utilized are imidazoles, triazoles and amdoamines.

Polymerization can be performed either in the presence of a solvent or in the absence of a solvent, however, is preferably performed in the presence of a solvent with respect to workability. The solvents include alcohols such as ethanol, isopropyl alcohol, n-butanol, iso-butanol and tert-butanol; ketones such as acetone methyl ethyl ketone, methyl isobutyl ketone and methyl amyl ketone; easters such as methylacetate, ethylacetate, butylacetate, methyllactate, ethyllactate and butyllactate; monocarboxilic acid esters such as methyl 2-oxypropionate, ethyl 2-oxypropionate, propyl 2-oxypropionate, butyl 2-oxypropionate, methyl 2-methoxypropionate, ethyl 2-methoxypropionate, propyl 2-methoxypropionate, butyl 2-methoxypropionate; polar solvents such as dimethylforamide, dimethylsulfoxide and N-methylpyrrolidone; ethers such as methyl cellosolve, cellosolve, butyl cellosolve, butyl carbitol and ethyl cellosolve acetate; propyrene glycols and esters thereof such as propyrene glycol, propyrene glycol monomethylether, propyrene glycol monomethylether acetate and propyrene glycol monobutylether acetate; halogen type solvent such as 1,1,1-trichloroethane and chloroform; ethers such as tetrahydrofuran and dioxane; aromatic compounds such as benzene, toluene and xylene; and inert liquid fluorides such as perfluorooctane and perfluorotri-n-butylamine; and any of these can be utilized.

Depending on polymerization capability of each monomer, such as a polymerization method in which polymerization is performed by titrating a monomer and an initiator into a reaction vessel is also effective to prepare polymer having a uniform composition. The un-reacted monomer can be removed by means of such as column filtration, re-precipitation purification and solvent extraction. It is also possible to remove the un-reacted monomer having a low boiling point by means of stripping.

Other than in the presence of a solvent, polymer dispersion which is prepared by emulsion polymerization or suspension polymerization can be also utilized. Manufacturing methods of these polymers are described, for example, in "Chemistry of Synthetic Latex", by Soichi Muroi, published by Polymer Publishing Association (1970).

The molecular weight of polymer is preferably 10,000-100,000 and more preferably 10,000-50,000, based on a weight average molecular weight as a polystyrene converted value of gel permeation chlomatography (GPC) measurement. When the molecular weight is not more than 10,000, a protective colloid function against silver halide grains is not sufficient to achieve insufficient dispersion ability, resulting in disabling micro-particle formation of silver halide. While, when the molecular weight is too large, viscosity of the dispersion may become too high or aggregation of silver halide grains may be caused.

In the case of synthetic polymer of this invention being acryl type polymer, it is possible to employ various procedures such as ion polymerization and living polymerization in addition to an ordinary radical polymerization. For example, it can be referred to such as "Quaternary Chemistry Introduction 18, Precision Polymerization", edited by Japanese Society of Chemistry, Masao Shimizu, Yohei Inoue, Yasuhiko Shirota, Shin Tsuge, Toshinobu Higashimura. As for polymerization initiators and catalysts, all compounds well known in the art can be employed.

As micro-particles usable in this invention, inorganic and organic micro-particles, well-known in the art, may be employed. Listed are, for example, ultrafine inorganic pigment particles, polymer micro-particles, graft polymer micro-particle carriers (DDS), electro-conductive metal-oxide micro-particles, semiconductor micro-particles, and metal colloid micro-particles. Of these, the metal colloid micro-particles are preferably employed. Also preferably employed are ultrafine inorganic pigment particles such as titanium oxide, boron nitride, $SnO_2$, $SiO_2$, $Cr_2O_3$, $\alpha$-$Al_2O_3$, $\alpha$-$Fe_2O_3$, $\alpha$-FeOOH, SiC, and cerium oxide; polymer micro-particles such as polymethyl methacrylate, polystyrene, and Teflon (being a registered trademark); electro-conductive metal-oxide micro-particles such as ZnO, $TiO_2$ and $SnO_2$ which are surface-treated with Sn or Sb; metal colloid micro-particles such as colloid micro-particles of gold, silver, silver halide, copper, platinum, iron, cobalt, nickel, aluminum, FePt, and CoPt; and specifically preferred are micro-particles of silver halide. The average sphere equivalent particle diameter of the micro-particles is preferably 1-1,000 nm, more preferably 10-500 nm, and still more preferably 30-100 nm. By controlling the particle diameter within this range, aggregation is prevented, and dispersion stability is enhanced.

A photosensitive emulsion of this invention is characterized by mixing a photosensitive silver halide grain dispersion, in which photosensitive silver halide grains are dispersed in an organic solvent exhibiting a water content of not more than 10%, into a photo-insensitive organic silver salt grain dispersion, in which photo-insensitive organic silver salt grains are dispersed in an organic solvent of a water content of not more than 10%.

<Photosensitive Silver Halide Grain Dispersion>

A photosensitive silver halide grain dispersion, in which photosensitive silver halide grains are dispersed in an organic solvent of a water content of not more than 10%, will now be explained.

A photosensitive silver halide grain dispersion according to this invention is in a state of photosensitive silver halide grains being dispersed in an organic solvent having a water content of not more than 10%.

As an organic solvent according to this invention, there is no limitation provided that water content is not more than 10% and preferably in a range of 0.1-10%, however, preferably listed are compounds of alcohols, esters and ketones, and specifically preferably ketone type organic solvents such as acetone, methyl ethyl ketone and diethyl ketone.

The water content referred to in this invention can be determined, for example, by Karl Fischer's method and specifically by use of such as a Karl Fischer's water content evaporation apparatus (VA-06, produced by Mitsubishi Chemical Corp.).

At the time of preparing a photosensitive silver halide grain dispersion according to this invention, silver halide grains are preferably dispersed in the presence of a protective colloid for dispersion and, as said protective colloid for dispersion, more preferably utilized are synthetic polymer, or synthetic polymer and natural polymer.

Further, synthetic polymer is preferably a compound provided with an amido group as a functional group and natural polymer is preferably a compound provided with a carboxyl group as a functional group.

Natural polymer utilized in this invention is not specifically limited and includes, for example, gelatin and derivatives thereof; graft polymer of gelatin and other polymer; protein such as albumin and casein; and saccharose derivatives such as sodium alginate and starch derivatives. In this invention, with respect to prevention of aggregation of silver halide grains, dispersion of silver halide grains in a relatively uniform state and final control of developed silver in a desired shape, preferably applied is gelatin and furthermore preferable are those in which characteristics of gelatin have been modified by chemical modification of hydrophilic groups such as an amino group and a carboxyl group with which gelatin is provided.

For example, hydrophobic modification of an amino group in a gelatin molecule includes such as phenylcarbamoylation, phthalation, acetylation, benzoylation and nitrophenylation, however, is not specifically limited thereto. Further, these substitution ratios are preferably not less than 95% and more preferably not less than 99%. Further, hydrophobic modification of a carboxylic group may be combined, and includes such as methyl esterification and amidoation, however, is not specifically limited thereto. The substitution ratio of a carboxyl group is preferably 50-90% and more preferably 70-90%. Herein, a hydrophobic group in the above hydrophobic modification refers to a group which increases hydrophobicity by substitution of an amino group or a carboxyl group of gelatin.

Further, in preparation of a photosensitive silver halide grain dispersion according to this invention, synthetic polymer alone or in combination with the above natural polymer are preferably utilized with respect to aimed effects of this invention being sufficiently exhibited.

Synthetic polymer according to this invention may be polymer which is soluble in both of water and an organic solvent in an identical state, however, also includes those can be made soluble or insoluble in water and an organic solvent by controlling pH or temperature.

For example, polymer provided with an acidic group such as a carboxyl group, may become hydrophilic in a dissociated state depending on a type, however, may become oleophilic to be made soluble in an organic solvent when pH is lowered to make a non-dissociated state. On the contrary, polymer provided with an amino group become oleophilic when pH is raised, and water-solubility is increased when pH is lowered to cause ionization.

A phenomenon of clouding point is well known with respect to a nonionic surfactant, and polymer, provided with characteristics to become oleophilic with rising temperature to be soluble in an organic solvent and to become water-soluble with descending temperature, is also included in this invention. Polymer is applicable provided being able to be uniformly emulsified even without being completely dissolved.

In this invention, various types of polymers are utilized in combination, therefore it is difficult to say which monomer at how much amount to be utilized, however, it can be easily understood that a desired polymer can be prepared by combining a hydrophilic monomer and a hydrophobic monomer at a suitable ratio.

Polymers, which are soluble in both of water and an organic solvent, are preferably those having a solubility against water of not less than 1 weight % (25° C.) and a solubility against such as methyl ethyl ketone, as an organic solvent, of not less than 5 weight % (25° C.), either by adjusting conditions such as pH at dissolution as described above or without adjustment.

As polymers soluble in both of water and an organic solvent according to this invention, such as so-called block polymer, graft polymer and comb-type polymer are more suitable than straight chain polymer, with respect to solubility. Comb-type polymer is specifically preferred. Herein, the isoelectric point of polymer is preferably not more than pH 6.

An etylenic unsaturated monomer containing a polyalkyleneoxide group may be utilized alone or in combination of at least two types.

In a manufacturing process of a silver salt photothermographic dry imaging material, a surfactant, particularly, a nonionic surfactant is preferably contained in a silver halide grain dispersion for the purpose of prevention of aggregation and uniform dispersion, of the above silver halide grains.

The nonionic surfactant is generally selected from those having a hydrophilicity/oleophilicity equilibrium defined by a "HLB" value, which reflects a ratio of a hydrophilic group and an oleophilic group in the molecule according to Griffin W. C. "J. Soc. Cosm. Chem., 1, 311 (1949)", of −18-18 and more preferably of −15-0.

As a nonionic surfactant utilized in a photosensitive silver halide emulsion according to this invention, preferable are surfactants represented by following formulas (NSA1) and (NSA2).

$$HO\text{-}(EO)_a\text{-}(AO)_b\text{-}(EO)_c\text{-}H \qquad \text{Formula (NSA1)}$$

$$HO\text{-}(AO)_d\text{-}(EO)_e\text{-}(AO)_f\text{-}H \qquad \text{Formula (NSA2)}$$

wherein, EO represents an ethyleneoxide group, AO represents an oxyalkylene group having a carbon number of not less than 3, and "a", "b", "c", "d", "e" and "f" each represent a number not less than 1.

Any of these surfactants are called as Pluronic-type nonionic surfactants, and in formula (NSA1) or (NSA2), an alkyleneoxy group having a carbon number of not less than 3 represented by AO includes an oxypropylene group, an oxybutylene group and oxy long-chain alkylene group, however, an oxypropylene group is most preferred.

Further, "a", "b" and "c" each represent a number of not less than 1, d, "e" and "f" each represent a number of not less than 1. "a" and "c" each are preferably 1-200 and more preferably 10-100, "b" is preferably 1-300 and more preferably 10-200. "d" and "f" each are preferably 1-100 and more preferably 5-50, "e" is preferably 1-100 and more preferably 2-50.

The mean molecular weight of a Pluronic-type nonionic surfactant represented by formula (NSA1) or (NSA2) is preferably 500-30,000 and more preferably approximately 1,000-20,000. At least one type of Pluronic-type nonionic surfactants represented by formula (NSA1) or (NSA2) is preferably provided with a ratio of an oxyethylene group in the whole molecule of not more than 50 weight %.

Nonionic surfactants of this type include such as Pluronic (a trade mark) P94 and Pluronic F68.

In this invention, nonionic surfactant is utilized at a concentration of 0.5-2% and preferably of 0.9-1.5.

(Photosensitive Silver Halide Grains)

Next, photosensitive silver halide grains employed in the photosensitive silver halide grain dispersion of this invention will be described.

Photosensitive silver halide grains according to this invention (in photographic industry, also simply referred to as silver halide grains or silver halide) refers to silver halide crystal grains, which can essentially absorb as an intrinsic characteristic of a silver halide crystal or can absorb visible light or infrared light artificially by a physicochemical method, as well as are manufactured by being processed so as to cause a physicochemical change at the interior or the surface of said silver halide crystal when absorbing light in any of the wavelength within an ultraviolet light to an infrared light region.

As photosensitive silver halide grains according to this invention, silver halide grains, conventionally, disclosed in such as many patent publications related to a silver salt photothermographic dry imaging material can be utilized. Specific examples of silver halide grains, which can be preferably utilized, are, for example, silver halide grains manufactured based on manufacturing methods, chemical properties such as a halogen component, and physical properties such as a shape, which are described in JP-A 2003-270755.

The halogen composition is not specifically limited, and may be any of silver chloride, silver chlorobromide, silver chloroiodobromide, silver bromide, silver iodobromide and silver iodide, however, is specifically preferably silver bromide, silver iodobromide or silver iodide.

Silver halide grains utilized in this invention is preferably provided with an appropriately small grain size to prevent milky-whitening after image formation as well as to obtain superior image quality, and the mean grain size is not less than 0.03 μm and not more than 0.10 μm, and preferably not less than 0.030 μm and not more than 0.055 μm, when grains having a mean grain size of less than 0.02 μm are eliminated from measurement.

The shape of silver halide grains includes such as cubic, octahedral, tetradecahedral, tabular, spherical, rod-shaped and potato-shaped grains, and specifically preferable among them are cubic, octahedral, teteradecahedral and tabular silver halide grains.

Photosensitive silver halide grains according to this invention are preferably utilized at 0.001-0.7 mol and more preferably at 0.03-0.5 mol, against 1 mol of silver aliphatic carboxylate which functions as a silver ion supplying source.

Photosensitive silver halide grains according to this invention are preferably thermal conversion internal latent image type (internal latent image type after thermal development) silver halide grains, that is, silver halide grains the surface sensitivity of which is decreased due to conversion from a surface latent image type to an internal latent image type by thermal development. In other words, silver halide grains; in which latent image formation on the surface is depressed because a latent image, capable of functioning as a catalyst of development reaction, is formed on the surface of said silver halide grains at exposure before thermal development, while a latent image is formed more in the interior than on the surface of said silver halide grains at exposure after thermal development process; are preferred with respect to sensitivity and image storage stability.

Thermal conversion internal latent image type silver halide grains according to this invention, similar to ordinary surface latent image type silver halide grains, are preferably utilized at 0.001-0.7 mol and more preferably at 0.03-0.5 mol, against 1 mol of silver aliphatic carboxylate which functions as a silver ion supplying source.

<Photo-insensitive Organic Silver Salt Grain Dispersion>

A photo-insensitive organic silver salt grain dispersion according to this invention is prepared by dispersing photo-insensitive silver salt grains in an organic solvent having a water content of not more than 10%.

As an organic solvent according to this invention, there is no specific limitation provided that water content is not more than 10% and preferably in a range of 0.1-10%, and preferably listed are compounds of alcohols, esters, ketones, in particular, ketone type organic solvent such as acetone, methyl ethyl ketone and diethyl ketone.

The water content referred to in this invention can be determined, for example, by Karl Fischer's method and specifically by use of such as a Karl Fischer's water content evaporation apparatus (VA-06, produced by Mitsubishi Chemical Corp.).

Photo-insensitive organic silver salt according to this invention is not specifically limited; however, is preferably photo-insensitive silver aliphatic carboxylate. Photo-insensitive silver aliphatic carboxylate utilized in this invention is silver salt which is relatively stable against light, however, functions as a silver ion supplying substance when being heated at 80° C. or higher in the presence of exposed photosensitive silver halide and a reducing agent, resulting in formation of a silver image.

Photo-insensitive organic silver salt of this invention may be any of silver aliphatic carboxylate which can supply a silver ion being reducible by a reducing agent. Silver salt of aliphatic carboxylic acid is specifically preferably silver salt of long chain aliphatic carboxylic acid (having a carbon number of 10-30 and preferably of 15-28). Preferable examples of silver aliphatic carboxylate include such as silver lignocerate, silver behenate, silver arachidate, silver stearate, silver oleate, silver laurate, silver caproate, solver myristate, silver palmitate, silver erucate and mixtures thereof.

In this invention, photo-insensitive organic silver salt (silver aliphatic carboxylate) preferably contains silver behenate of not less than 50 mol % and not more than 100 mol %. Furthermore preferably, silver behenate is contained at not less than 80 mol % and not more than 90 mol %. Further, preferably utilized is silver aliphatic carboxylate provided with a silver erucate content of not more than 2 mol %, more preferably of not more than 1 mol % and furthermore preferably of not more than 0.1 mol %.

The equivalent spherical diameter of photo-insensitive organic silver salt grains according to this invention is preferably not less than 0.05 μm and not more than 0.50 μm and more preferably not less than 0.10 μm and not more than 0.50 μm. Further, the grain size distribution is preferably monodispersed. Monodispersibility can be expressed by a standard deviation of a mean diameter, the standard deviation of photo-insensitive organic silver salt grains according to this invention is preferably not more than 0.3 and more preferably not less than 0.01 and not more than 0.2.

The above grain size and grain size distribution each can be determined by commonly known measurement methods of grain size distribution such as a laser diffraction method, a centrifugal precipitation optical transmission method, an X-ray transmission method, an electrical detection band method, a light shielding method, an ultrasonic attenuation spectrometer method and a method to perform calculation based on images, however, among them, a laser diffraction method and a method to perform calculation based on images are preferable for micro-particles. Furthermore, a laser diffraction method is preferable, and can be applied to silver aliphatic carboxylate grains dispersed in a liquid by use of a laser diffraction grain size distribution analyzer available on the market.

In the following, shown is a specific example of a measurement method of grain size and grain size distribution of photo-insensitive organic silver salt grains.

In a beaker of 100 ml, 0.01 g of a silver aliphatic calboxylate grain sample was charged, and after being added with 0.1 g of Nonion NS-210 (produced by NOF Corp.) and 40 ml of water, the resulting mixture was subjected to ultrasonic dispersion at room temperature. Utilizing the resulting dispersion, the mean grain size and standard deviation can be measured by use of a laser diffraction grain size analyzer (SALD-2000, manufactured by Shimazu Seisakusho Co., Ltd.).

To prepare photo-insensitive silver aliphatic carboxylate as photo-insensitive organic silver salt grains so as to make a mean equivalent spherical diameter, which is defined in this invention, of not less than 0.05 μm and a standard deviation of equivalent spherical diameter of not more than 0.3 μm, it is preferred to perform a reaction and preparation according to the following mixing method.

Silver aliphatic carboxylate grains in this invention are preferably prepared by reacting a solution containing silver ion and an alkali metal salt aliphatic carboxylate solution or suspension. The solution containing silver ion is preferably a silver nitrate aqueous solution, and the alkali metal salt aliphatic carboxylate solution or suspension is preferably an aqueous solution or a water dispersion, addition and mixing of which are preferably simultaneously performed. The method of addition and mixing may be either a method in which addition is performed to the liquid surface of a reaction bath, a method in which addition is performed to the interior of a liquid, however, is preferably a method in which addition is performed on the way of a transportation means. Addition on the way of a transportation means refers to line-mixing, and the mixing of a solution containing silver ion and an alkali metal salt aliphatic carboxylate solution or suspension is preferably performed before the solutions go into a batch to stock a mixed solution containing the reaction product. Stirring means at the mixing portion may employ any means of mechanical stirring such as a homomixer, a static mixer, or a turbulent flow. effect; however, it is preferred not to utilize mechanical stirring. Herein, at mixing on the way of transportation means, in addition to a solution containing silver ion and a silver aliphatic carboxylate solution or suspension, the third solution or suspension such as water and a circulation liquid of a mixed solution stored in a batch after mixing may be mixed.

In this invention, silver nitrate aqueous solution concentration is preferably in a range of 1-15 weight % and concentration of a metal salt of aliphatic carboxylic acid aqueous solution or water dispersion is preferably in a range of 1-5 weight %. In the outside of the above concentration range, it is not practical due to significant deterioration of productivity at a lower concentration range, while difficulty to adjust grain size and size distribution into a range of this invention at a higher concentration. Further, the mixing mol ratio of silver nitrate against alkali metal aliphatic carboxylate is preferably in a range of 0.9-1.1, and it becomes difficult to adjust grain size and size distribution into a range of this invention as well as decrease of silver aliphatic carboxylate yield and generation of silver oxide, which causes fogging, may be induced, when the ratio is out of this range.

In this invention, prepared silver aliphatic carboxylate is preferably subjected to washing with water and post drying, with respect to the storage stability. Washing is performed primarily for the purpose of removing such as non-reacted ions, however, may be performed by use of an organic solvent in consideration of a drying process to follow the washing. Washing is preferably performed at not higher than 50° C. and more preferably at not higher than 30° C. When washing is performed at over 50° C., it becomes difficult to adjust grain size and size distribution into a range of this invention. Further, drying is preferably performed at a temperature lower than the phase transition temperature of silver aliphatic carboxylate, furthermore preferably at not higher than 50° C. and specifically preferably at a temperature as low as possible. When drying is performed at over the phase transition temperature, it becomes difficult to adjust grain size and size distribution into a range of this invention.

In this invention, preparation of silver aliphatic carboxylate is preferably performed in the absence of photosensitive silver halide grains. In the case of preparation in the presence of photosensitive silver halide grains, it becomes difficult to adjust grain size and size distribution of silver aliphatic carboxylate grains into a range of this invention in view of compatibility with fog characteristics.

Photo-insensitive silver aliphatic carboxylate according to this invention can be utilized at a desired amount, however, preferably at an amount in a range of 0.8-1.5 g/m$^2$ and more preferably in a range of 1.0-1.3 g/m$^2$, based on the total silver amount including silver halide.

Prior to preparation of silver aliphatic carboxylate, alkali metal salt of aliphatic carboxylic acid has to be prepared, and examples of types of alkali metal salts utilized at that time include such as sodium hydroxide, potassium hydroxide and lithium hydroxide. One type of alkali metal salt among them such as potassium hydroxide is preferably utilized; however, it is also preferred to utilize sodium hydroxide and potassium hydroxide in combination. The ratio of combination use is preferably in a range of 10/90-75/25 based on a mol ratio of the both of the above hydroxides. The viscosity of a reaction solution can be controlled in a suitable state by using alkali metal salt in the above range when the alkali metal salts is reacted with aliphatic carboxylic acid to form alkali metal salt of aliphatic carboxylic acid.

Photo-insensitive organic silver salt grain dispersion containing silver aliphatic carboxylate grains according to this invention is a mixture of free aliphatic carboxylic acid, which has not formed silver salt, and silver aliphatic carboxylate, and the ratio of the former is preferably lower against the latter with respect to such as image storage stability. That is, said emulsion according to this invention preferably contains 3-10 mol % and specifically preferably 4-8 mol % of aliphatic carboxylic acid against said silver aliphatic carboxylate grains.

Herein, specifically, by determining each of the total aliphatic carboxylic acid amount and the free aliphatic carboxylic acid amount according to the following method, the amounts of silver aliphatic carboxylate and free aliphatic carboxylic acid and each ratio thereof or the ratio of free aliphatic acid against total aliphatic carboxylic acid are calculated.

<Determination of Total Aliphatic Carboxylic Acid (the Total of Those Arising from the Aforesaid Silver Aliphatic Carboxylate and Free Acid)>

(1) Sample of approximately 10 mg (a peeled off weight when the sample is peeled off from a photosensitive material) is weighed precisely and was charged in an egg-plant type flask of 200 ml.

(2) Methanol of 15 ml and a 4 mol/L hydrochloric acid of 3 ml were added and the mixture is ultrasonic dispersed for 1 minute.

(3) The system is refluxed for 60 minutes with addition of zeolite produced by Teflon (a trade mark).

(4) After cooling, 5 ml of methanol are added over a reflux condenser to wash out those adhered on the reflux condenser into an egg-plant type flask (twice).

(5) The prepared reaction solution is subjected to ethyl acetate extraction (ethyl acetate 100 ml, water 70 ml are added for liquid separation, twice).

(6) The resulting product is dried under reduced pressure for 30 minutes.

(7) A benzanthrone solution of 1 ml, as an internal standard, is charged in a messflask of 10 ml (benzanthrone of approximately 100 mg is dissolved in toluene and the solution is made to 100 ml with toluene).

(8) A sample dissolved in toluene is charged in a messflask of (7) and messed up by toluene.

(9) Gas chromatographic (GC) measurement is performed under the following conditions.

Apparatus: HP-5890+HP-Chemistation

Column: HP-1, 30 m×0.32 mm×0.25 μm (manufactured by HP)

Injection inlet: 250° C.

Detector: 280° C.

Oven: constant at 250° C.

Carrier gas: He

Head pressure: 80 kPa

<Determination of Free Aliphatic Carboxylic Acid>

(1) Sample of approximately 20 mg is weighed precisely and was charged in an egg-plant type flask of 200 ml, and the mixture is added with 10 ml of methanol followed by being subjected to ultrasonic dispersion for 1 minute (free organic carboxylic acids are extracted).

(2) The dispersion is filtered and the filtrate is charged in an egg-plant type flask and dried (free organic carboxylic acids will be separated).

(3) Methanol of 15 ml and 3 ml of a 4 mol/L hydrochloric acid are added and the mixture is subjected to ultrasonic dispersion for 1 minute.

(4) The system is refluxed for 60 minutes with addition of zeolite produced by Teflon®.

(5) The prepared reaction solution is added with 60 ml of water and 60 ml ethyl acetate to extract methyl esterificated products of organic carboxylic acids into an ethyl acetate phase. The ethyl acetate extraction is performed twice.

(6) The ethyl acetate phase is evaporated to dryness, followed by being dried under reduced pressure for 30 minutes.

(7) A benzanthrone solution of 1 ml (an internal standard: benzanthrone of approximately 100 mg is dissolved in toluene and the solution is made to 100 ml with toluene) is charged in a messflask of 10 ml.

(8) (6) is dissolved in toluene, which is charged in a messflask of (7) and messed up by toluene.

(9) Gas chromatographic (GC) measurement is performed under the following conditions.

Apparatus: HP-5890+HP-Chemistation

Column: HP-1, 30 m×0.32 mm×0.25 μm (manufactured by HP)

Injection inlet: 250° C.

Detector: 280° C.

Oven: constant at 250° C.

Carrier gas: He

Head pressure: 80 kPa

The shape of silver aliphatic carboxylate utilized in this invention is not specifically limited and may be any of a needle from, a bar form, a tabular form or a flake form. In this invention, silver aliphatic carboxylate of a flake form, and silver aliphatic carboxylate of a short needle form or a rectangular solid form, having a length ratio of a long axis to a short axis of not more than 5, are preferably utilized.

In this invention, silver aliphatic carboxylate of a flake form is defined as follows. Silver aliphatic carboxylate is observed through an electronmicroscope, a form of a silver aliphatic carboxylate grain being approximated by a rectangular solid, and x is determined as follows employing the shorter values a and b when the edges of this rectangular solid are named as a, b and c from the shortest.

$$x=b/a$$

In this manner, x is determined with respect to approximately 200 grains, and those satisfies a telation of x (average) ≧1.5, preferably 30≧x (average)≧1.5 and more preferably 20≧x (average)≧2.0 are defined as a flake form when the mean value is x (average). A needle form satisfies 1≦x (average)<1.5.

In flake form grains, "a" is interpreted as a thickness of a tabular grain when a plane having b and c as edges is a primary plane. Average of "a" is preferably not less than 0.01 μm and more preferably 0.1-0.20 μm. A mean value of c/b is preferably 1-6, more preferably 1.05-4, furthermore preferably 1.1-3 and specifically preferably 1.1-2.

Silver aliphatic carboxylate according to this invention may be crystal grains provided with a core/shell structure disclosed in such as European Patent No. 1,168,069 A1 and JP-A 2002-23303. Herein, to make a core/shell structure, organic silver salt, for example, in the whole of or a part of either a core portion or a shell portion, silver salt of organic compounds such as phthalic acid and benzoimidazole may be utilized as a constitution component of said crystal grains.

In this invention, silver aliphatic carboxylate grains of a tabular form are preferably dispersed and ground by use of a medium homogenizer or a high pressure homogenizer after having been pre-dispersed appropriately together with a binder and a surfactant. As the above described pre-dispersion method, utilized can be such as, an ordinary stirrer of an anchor type and a propeller type, high speed rotational centrifugal radial type stirrer (dissolver) and a high speed rotational share type stirrer (homo-mixer).

Further, as the above media homogenizers, for example, rotary moving mills such as a ball mill, a planetary ball mill and a vibration ball mill, medium stirring mills such as a beads mill and an atliter, in addition to a basket mill can be utilized. As a high pressure mill, utilized can be various types such as a type in which a liquid is collided against such as a plug, a type in which a liquid is divided into plural portions to be collided against each other, and a type in which a liquid is passed through a narrow orifice.

Ceramics employed as ceramics beads for media dispersion is specifically preferably yttrium stabilized zirconia or zirconia reinforced almina (hereinafter, these ceramics containing zirconia are abbreviated as zirconia) because these generates minimum amount of impurity due to friction with beads and a homogenizer at the time of dispersion.

In equipment utilized at the time of dispersing tabular silver halide aliphatic carboxylate grains according to this invention, preferably employed as materials of the parts, with which silver halide aliphatic carboxylate grains contact, are ceramics such as zirconia, almina, silicon nitride and borone nitride, or diamond, and among them more preferably zirconia. At the time of the above dispersion, the binder concentration is preferably 0.1-10% based on the weight of silver halide aliphatic carboxylate grains, and the solution temperature is preferably lower than 45° C. throughout from pre-dispersion to primary dispersion. Further, as preferable operation conditions of the primary dispersion, for example, in the case of employing a high pressure homogenizer as dispersion means, operation conditions of 29-100 MPa and at least twice operation times are preferable. Further, in the case of employing a medium homogenizer as dispersion means, preferable conditions include a circumferential speed of 6-13 m/sec.

In this invention, photo-insensitive silver halide aliphatic carboxylate grains are preferably those having been formed in the presence of a compound which functions as a crystal growth restrainer or a dispersant. Further, a compound which functions as a crystal growth restrainer or a dispersant is preferably an organic compound provided with a hydroxyl group or a carboxyl group.

In this invention, a compound which functions as a crystal growth restrainer or a dispersant refers to a compound provided with a function or effect to make a smaller particle diameter or a more mono-dispersibility, when silver halide aliphatic carboxylate grains are produced in the presence of said compound than without said compound, in the manufacturing process of silver halide aliphatic carboxylate grains. Specific examples include alcohols having a carbon number of less than 10 and preferably secondary alcohols, tertiary alcohols, glycols such as ethylene glycol and propyrene glycol, polyethers such as polyethylene glycol, and glycerins. The preferable addition amount is 10-200 weight %. against silver halide aliphatic carboxylate grains.

On the other hand, also preferable are branched aliphatic carboxylic acids, each including isomers, such as isoheptanoic acid, isodecanoic acid, isotridecanoic acid, isomyristinic acid, isopalmitic acid, isostearic acid, isoarachidinic acid, isobehenic acid and isohexasanoic acid. In this case, preferable side chains include alkyl groups or alkenyl groups having a carbon number of not more than 4. Further, listed are aliphatic unsaturated carboxylic acids such as palmitoleic acid, oleic acid, linolic acid, linolenic acid, moroctic caid, eicosenoic acid, arachidonic acid, eicosapentaenoic acid, erucic acid, docosapentaenoic acid, docosahexaenoic acid and selacholenoic acid. The preferable addition amount is 0.5-10 mol % of silver aliphatic carboxylate.

Also listed as preferable compounds are glycocides such as glucocide, galactocide and fructocide; trehalose type disaccharides such as trehalose and sclose; polysaccharides such as glycogen, dextrine, dextrane and alginic acid; cellosolves such as methylcellosolve and ethylcellosolve; water-soluble organic solvents such as sorbitane, sorbite, ethyl acetate, methyl actate and dimethylformamide; and water-soluble polymers such as polyvinyl alcohol, polyacrylic acid, acrylic acid copolymers, maleic acid copolymers, carboxymethyl cellulose, hydroxypropyl cellulose, hydroxypropylmethyl cellulose, polyvinyl pyrrolidone and gelatin. The preferable addition amount is 0.1-20 weight % against silver aliphatic carboxylate.

Alcohols having a carbon number of not more than 10 and preferably secondary alcohols such as isopropylalcohol and tertiary alcohols such as t-butylalcohol increase solubility of alkali metal aliphatic carboxylate to reduce the viscosity and enhance stirring efficiency, resulting in promotion of mono-dispersibility and making smaller particle diameter. Since branched aliphatic carboxylic acids and unsaturated aliphatic carboxyliac acids are provided with steric hindrance higher than straight chain aliphatic carboxylic acid, which is a primary component at the time of crystallization of silver aliphatic carboxylate; and disorder of the crystal lattice becomes large not to produce a large crystal, resulting in a smaller particle diameter.

Next, other constitutional elements of a silver salt photothermographic dry imaging material of this invention will be explained.

(Chemical Sensitization)

Photosensitive silver halide grains according to this invention can be subjected to chemical sensitization, which is conventionally disclosed in such as many Patent Documents concerning a silver salt photothermographic dry imaging material. For example, by utilizing compounds which release calcogen such sulfur, selenium and tellurium, or noble metal compounds which release a noble metal ion such as a gold ion, based on such as methods described in JP-A Nos. 2001-249428 and 2001-249426, provided can be chemical sensitivity centers (chemical sensitivity specks), which capture electrons or positive holes (holes) generated by photo-excitation of photosensitive silver halide grains or spectral sensitizing dyes on said grains. It is specifically preferable that chemical sensitization is performed by use of organic sensitizer containing a calcogen atom.

These organic sensitizers containing a calcbgen atom are preferably compounds provided with a group capable of adsorbing on silver halide and an unstable calcogen atom portion.

As these organic sensitizers, organic sensitizers having various structures, which are disclosed in such as JP-A Nos. 60-150046, 4-109240, 11-218874, 11-218875, 11-218876 and 11-194447, can be utilized, however, among them preferable is at least one type of compounds having a structure in which a calcogen atom is bonded with a carbon atom or a phosphor atom via a double bond. Specifically preferable are such as thiourea derivatives provided with a heterocyclic group and triphenyl phosphinsulfide derivatives.

In the case that chemical sensitization is applied on the surface of photosensitive silver halide grains according to this invention, it is preferable that said chemical sensitization effect is essentially distinguished after thermal development process has elapsed. Herein, that the chemical sensitization effect is essentially distinguished refers to that the sensitivity of said imaging material obtained by the aforesaid chemical sensitization technique is decreased to not more than 1.1 times of the sensitivity without chemical sensitization after thermal development. To distinguish the chemical sensitization effect at thermal development process, it is necessary to incorporate a suitable amount of an oxidant, which can destroy chemical sensitivity centers (chemical sensitivity specks) by an oxidation reaction, such as the aforesaid halogen radical releasing compound in an emulsion layer or/and a photo-insensitive layer of said imaging material at the time of thermal development. The content of said oxidant is preferably adjusted in consideration of such as oxidizing power of an oxidant and the decreasing degree of a chemical sensitization effect.

(Spectral Sensitization)

Photosensitive silver halide grains according to this invention are preferably subjected to spectral sensitization by adsorbing a spectral sensitizing dye. Utilized can be spectral sensitizing dyes, which are conventionally disclosed in many patent publications related to a silver salt photothermographic dry imaging material, such as cyanine dye, merocyanine dye, complex cyanine dye, complex merocyanine dye, holopoler cyanine dye, styryl dye, hemicyanine dye, oxonol dye and hemioxonol dye.

In a silver salt photothermographic dry imaging material of this invention, a specific example of spectral sensitization technologies preferably utilized is, for example, one based on a spectral sensitization technology in which at least one type selected from spectral sensitizing dyes represented by formulas (1) and (2) described in JP-A 2004-309758 is utilized.

In an emulsion which contains photosensitive silver halide and silver aliphatic carboxylate and is utilized for a silver salt photothermographic dry imaging material, a substance which is not provided with a spectral photosensitizing effect or does not essentially absorb visible light but exhibits a supersensitization effect itself, may be contained together with a sensitizing dye in the emulsion to supersensitize the silver halide grains.

Useful sensitizing dyes, dye combinations which exhibit supersensitization and substances which exhibit supersensitization are described in such as Reseach Disclosure (hereinafter, abbreviated as RD) 17643, p. 23 item IV-J (December 1978), Examined Japanese Patent Application Publication Nos. 9-25500 and 43-4933, JP-A Nos. 59-19032, 59-192242 and 5-341432, however, heterocyclic aromatic mercapto compounds or mercapto derivative compounds are preferred as a supersensitizer.

Other than the above supersensitizer, a large cyclic compound provided with a hetero atom as described in JP-A 2001-330918 is also utilized as a supersensitizer.

In photosensitive silver halide grains according to this invention, it is preferable that a spectral sensitizing dye is adsorbed on the surface of said silver halide grains to be applied with chemical sensitization, and said spectral sensitization effect has to be essentially distinguished after thermal development process has elapsed. Herein, that the spectral sensitization effect is essentially distinguished refers to that the sensitivity of said imaging material, which has been obtained by such as a sensitizing dye and a supersensitizer, is decreased to not more than 1.1 times of the sensitivity without spectral sensitization after thermal development.

To distinguish the spectral sensitization effect at a thermal development process, it is necessary to utilize a spectral sensitizing dye which is easily desorbed from silver halide by heat or to incorporate an oxidant, which can destroy a spectral sensitizing dye by an oxidation reaction, such as a suitable amount of the aforesaid halogen radical releasing compound in an emulsion layer or/and a photo-insensitive layer of said imaging material at the time of thermal development. The content of said oxidant is preferably adjusted in consideration of such as oxidizing power of an oxidant and the decreasing degree of a spectral sensitization effect.

[Silver Ion Reducing Agent]

A reducing agent according to this invention is those which can reduce silver ion in a photosensitive layer, and also referred to as a developer. A reducing agent includes compounds represented by following formula (RD1).

In this invention, as a reducing agent of silver ion, specifically preferably utilized, as at least one type of reducing agents, is a compound represented by following formula (RD1), alone or in combination with other reducing agent provided with a different chemical structure.

Formula (RD1)

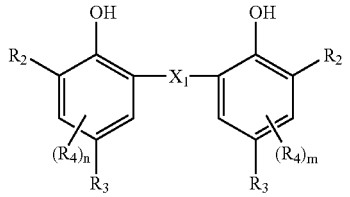

In above formula (RD1), $X_1$ represents a chalcogen atom or $CHR_1$, and $R_1$ represents a hydrogen atom, a halogen atom, an alkyl group, an alkenyl group, an aryl group or a heterocyclic group. $R_2$'s represent an alkyl group, and may be same or different. $R_3$ represents a hydrogen atom or a group capable of substituting to a benzene ring. $R_4$ represents a group capable of substituting to a benzene ring, and m and n each represent 0 or an integer of 1 or 2.

Among compounds represented by formula (RD1), particularly, a highly active reducing agent (hereinafter, referred to as a compound of formula (RD1a)), in which at least one of $R_2$'s is a secondary or tertiary alkyl group, is preferably utilized with respect to obtaining a thermally developable photosensitive material which exhibits high density and excellent image storage stability. In this invention, it is preferable to utilize a compound of formula (RD1a) and a compound of formula (RD2) in combination to obtain desirable tone.

Formula (RD2)

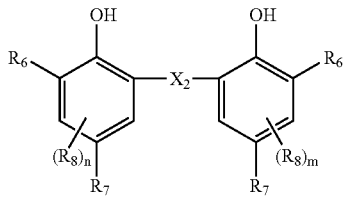

In above formula (RD2), $X_2$ represents a chalcogen atom or $CHR_5$, and $R_5$ represents a hydrogen atom, a halogen atom, an alkyl group, an alkenyl group, an aryl group or a heterocyclic group. $R_6$'s represent an alkyl group, and may be same or different; however, are never a secondary or tertiary alkyl group. $R_7$ represents a hydrogen atom or a group capable of substituting to a benzene ring. $R_8$ represents a group capable of substituting on a benzene ring, and m and n each represent 0 or an integer of 1 or 2.

The using amount ratio, [weight of compound of formula (RD1a)]/[weight of compound of formula (RD2)] is preferably 5.95-45.55 and more preferably 10/90-40/60.

(Tone of Image)

Next, tone of images obtained by thermal development of a silver salt photothermographic dry imaging material will be described.

It is said that tone of output images for medical diagnostic application such as conventional X-ray photographic film is preferably cold image tone to easily obtain more accurate diagnostic observation for an examiner. Herein, cold image tone referred to pure black tone or bluish black tone in which black images have a bluish tone. On the other hand, warm tone refers to warm black tone in which black images have brownish tone, however, to discuss more precisely and quantitatively, in the following, it will be explained based on an expression method proposed by International Commission on Illumination (CIE).

Terms related to tone, "colder tone" and "warmer tone" can be expressed by hue angles hab at the minimum density Dmin and at an optical density of 1.0. That is, hue angle hab is determined according to the following equation by utilizing color coordinates a*, b* in a L*a*b* color space having approximately uniform visual steps which has been recommended by International Commission on Illumination in 1976.

$$hab=\tan^{-1}(b^*/a^*)$$

As a result of study according to the above expression based on the above hue angle, it has been proved that tone after development of a photothermographic dry imaging material of this invention is preferably 180°<hab<270°, more preferably 200°<hab<270° and most preferably 220°<hab<260°, as a range of color angle. This fact is disclosed in JP-A 2002-6463.

Herein, conventionally, it has been known that a diagnostic image having a preferable visual tone can be obtained by adjusting u*, v* or a*, b* in CIE 1976 (L*u*v*) or (L*a*b*) color space around an optical density of 1.0 to be a specific values, which is described, for example, in JP-A 2000-29164.

However, as disclosed in JP-A 2004-94240, with respect to a silver salt photothermographic dry imaging material of this invention, it has been found that when u*, v* or a*, b* are plotted at various photographic densities on a graph having u* or a* as abscissa and v* or b* as ordinate in CIE 1976 (L*u*v*) space or (L*a*b*) space to form a linear regression line, a diagnostic capability not lower than a conventional wet processing silver salt photosensitive material can be obtained by adjusting the linear regression line in a specific region. In the following, the preferable region of conditions will be described.

(1) When each density at optical densities of 0.5, 1.0, 1.5 and the minimum of a silver image obtained after thermal development of a silver salt photothermographic dry imaging material are measured and u* and v* at the above optical densities being arranged in a two dimensional coordinate having u* as abscissa and v* as ordinate in CIE 1976. (L*u*v*) color space to form a linear regression line, decision coefficient (double decision) $R^2$ of said linear regression line is preferably 0.998-1.000. Further, it is preferred that v* value at the crossing point of said linear regression line with the ordinate is −5-5 as well as the slope (v*/u*) is 0.7-2.5.

(2) Further, when each density at optical densities of 0.5, 1.0, 1.5 and the minimum, of said photothermal dry imaging material was measured and u* and v* at the above optical densities being arranged in a two dimensional coordinate having u* as abscissa and v* as ordinate in CIE 1976 (L*u*v*) color space to form a linear regression line, decision coefficient (double decision) $R^2$ of the linear regression line is preferably 0.998-1.000. Further, b* value at the crossing point of said linear regression line with the ordinate is −5-5 as well as the slope (b*/a*) is preferably 0.7-2.5.

Next, the method to form a linear regression line described above, that is, an example of a measuring method of u*, v* and a*, b* in CIE 1976 color space will be explained.

A four-step wedge sample including an unexposed portion and optical densities of 0.5, 1.0 and 1.5 is prepared by use of a thermal processor. Each wedge density portion thus prepared is measured by use of a spectral color meter (such as CM-3600d, manufactured by Minolta Co. Ltd.) to calculate u*, v* and a*, b*. As the measurement conditions at that time, measurement is carried out employing F7 light source at a visional angle of 10 degrees in a transparent measurement mode. Measured u*, v* or a*, b* are plotted on a graph having u* or a* as abscissa and v* or b* as ordinate to determine a linear regression line, and then decision coefficient (a double determination) $R^2$, an intercept and an inclination are obtained.

Next, a concrete method to obtain a linear regression line provided with the above characteristic will be explained.

In this invention, it is possible to optimize the developed silver shape to obtain a preferable tone by adjusting the addition amount of such as directly or indirectly related compounds, such as a developer (a reducing agent), silver halide grains, silver aliphatic carboxylate and a toning agent described below, in a development reaction process. For example, to form developed silver of a dendrite shape provides a tendency of being bluish while to form developed silver of a filament shape provides a tendency of being yellowish. That is, it is possible to control the tone in consideration of such characters of the shape of developed silver.

Conventionally, phthalazinone or phthalazine and phthalic acids, and phthalic acid anhydrides are generally utilized as a toning agent. Examples of a preferable toning agent are disclosed in such as RD 17029, and U.S. Pat. Nos. 4,123,282, 3,994,732, 3,846,136 and 4,021,249.

In addition to such toning agents, couplers disclosed in such as JP-A 11-288057 and European Patent No. 1,134,611 A2, and leuco dyes which will be detailed below can be utilized to control the tone. In particular, it is preferable to utilize a coupler or a leuco dye for fine tuning of the tone.

(Leuco Dye)

In a silver salt photothermographic dry imaging material of this invention, the tone can also be adjusted by use of a leuco dye as described above. A leuco dye is preferably any compound which is colorless or slightly colored and is oxidized to be a colored state when being heated at a temperature of approximately 80-200° C. for approximately 0.5-30 seconds, and any leuco dye, which is oxidized by such as an oxidized substance of the above reducing agent to form a dye, can be also utilized. A compound which is provided with pH sensibility and can be oxidized into a colored state is useful.

Typical leuco dyes suitable to be utilized in this invention are not specifically limited, and include such as bisphenol leuco dyes, phenol leuco dyes, indoaniline leuco dyes, acrylated azine leuco dyes, phenoxazine leuco dyes, phenodiazine leuco dyes and phenothiazine leuco dyes. Further, useful are leuco dyes disclosed in such as U.S. Pat. Nos. 3,445,234, 3,846,136, 3,994,732, 4,021,249, 4,021,250, 4,022,617, 4,123,282, 4,368,247 and 4,461,681; and JP-A Nos. 50-36110, 59-206831, 5-204087, 11-231460, 2002-169249 and 2002-236334.

To adjust the tone to a predetermined value, it is preferable to utilize leuco dyes of various colors alone or in combination of plural types. In this invention, to prevent change of tone (particularly, of yellowish) depending on the using amount and using ratio thereof in the case of employing a highly active reducing agent, or to prevent the image particularly at a density portion as high as not lower than 2.0 from having excessive reddish tone in the case of employing micro-particle silver halide, it is preferable to utilize leuco dyes which provide yellow color and cyan color in combination and adjust the using amount.

The image density is suitably controlled depending on the tone of the developed silver itself. In this invention, it is preferably colored at an optical reflection density of 0.005-0.50 and to adjust the tone of the image in the preferred range listed above. The total of the maximum densities at the maximum absorption wavelength of color images formed by the leuco dyes is preferably set within 0.01-0.50, more preferably 0.02-0.30 and most preferably 0.03-0.10.

[Binder]

In the silver salt photothermographic dry imaging material of this invention, a binder may be incorporated in a photosensitive layer and in a photo-insensitive layer of this invention for various functions.

A binder contained in a photosensitive layer of this invention can consist of an organic silver salt, silver halide grains, a reducing agent and other components, and a suitable binder may be transparent or translucent, but generally colorless, including natural polymers, synthetic resin, polymers and oligomers, other media to form a film such as described in paragraph "0069" of JP-A 2001-330918.

Among these, specifically preferable examples include methacrylic acid alkyl esters, methacrylic acid arylesters and styrenes. Among such polymer compounds, polymer compounds provided with an acetal group are preferably utilized. Among polymer compounds provided with an acetal group, more preferred is polyacetal having an acetal structure, which include polyvinylacetal described in U.S. Pat. Nos. 2,358,836, 3,003,879 and 2,828,204; and BP No. 771,155. As polymer compounds provided with an acetal group, compounds represented by formula (V) described in "105" of JP-A 2002-287299 are specifically preferred.

In a photosensitive layer of this invention, the above polymer is preferably utilized as a primary binder. A primary binder referred here means "a state of the above binder occupying not less than 50 weight % of the total binder". Therefore, other polymers may be blended within a range of less than 50 weight %. These polymers to be blended are not limited provided being soluble in a solvent which can dissolve a polymer of this invention. More preferably, listed are such as polyvinyl acetate, polyacryl resin and urethane resin.

Glass transition temperature (Tg) of a binder utilized in this invention is preferably 70-105° C. with respect to obtaining a sufficient maximum density in image formation.

A binder of this invention has a number average molecular weight of 1,000-1,000,000 and preferably of 10,000-500,000, and a polymerization degree of approximately 50-1,000.

Further, as for a photo-insensitive layer such as an overcoat layer and an under-coat layer, in particular, for a protective layer and a back-coat layer, polymers such as cellulose esters, specifically triacetyl cellulose and cellulose acetate butyrate, which are provided with a high softening point, are preferred. Herein, at least two types of binders may be appropriately utilized in combination, as described above.

Such binders are utilized in a range of effectively functioning as a binder. The effective range can be easily determined by the manufacturer in the corresponding industry. For example, as an index of the case of holding organic silver salt in a photosensitive layer (an image forming layer), the ratio of a binder to an organic silver salt is preferably 15/1-1/2 (weight ratio) and specifically preferably 8/1-1/1. That is, the amount of a binder in a photosensitive layer is preferably 1.5-6 g/m$^2$ and more preferably 1.7-5 g/m$^2$. When it is less than 1.5 g/m$^2$, density in an unexposed portion may significantly increased, resulting in making the material unusable.

An organic gelation agent may be incorporated in a photosensitive layer. Herein, an organic gelation agent refers to a compound which is provided with a function of canceling or decreasing fluidity of a system by being added in an organic liquid, such as polyhydric alcohols.

It is also a preferred embodiment to contain water-based dispersed polymer latex in a photosensitive layer coating composition. In this case, a water-based dispersion preferably occupies not less than 50 weight % of the total binder in a photosensitive layer coating composition. Further, in the case of utilizing polymer latex in preparation of a photosensitive layer, not less than 50 weight % of the total binder in a photosensitive layer is preferably polymer arising from polymer latex and more preferably not less than 70 weight %.

(Cross-linking Agent)

In a photosensitive layer according to this invention, incorporated may be a cross-linking agent which connects binders of this invention each other by a cross-linking bond. It has been known that film adhesion is improved as well as uneven development is decreased by employing a cross-linking agent against the above binder, however, there are also effects of depressing fog during storage and depressing generation of printout silver after development.

Cross-linking agents utilized include various cross-linking agents conventionally employed for a photographic light-sensitive material, such as an aldehyde type, an epoxy type, an ethyleneimine type, a vinylsulfon type, a sulfonic acid ester type, an acryloyl type, a carbodiimide type or silane compound type cross-linking agents, which are described in JP-A 50-69216, and preferable are an isocyanate type, a silane compound type, epoxy compounds and acid anhydrides.

Isocyanate type cross-linking agents are isocyanates provided with at least two isocyanate groups and adducts thereof, more specifically includes aliphatic diisocyanates, aliphatic diisocyanates provided with a cyclic group, benzene diisocyanates, naphthalene didisocyanates, biphenyl isocyanates, diphenylmethane diisocyanates, triphenylmethane diisocyanates, triisocyanates, tetraisocyanates, adducts of these isocyanates, and adducts of these isoyanates with secondary or tertiary polyhydric alcohols. As specific examples, isocyanate compounds described in pp. 10-12 of JP-A 56-5535 can be utilized.

Herein, adducts of isocyanate with polyhydric alcohol are provided with a high capability of preventing generation of layer peeling, image slippage and bubbles, by enhancing the inter-layer adhesion. Such isocyanate may be incorporated in any portion of a thermally developable photosensitive material. For example, isocyanate can be added in a support (in particular, in the case of a support being paper, can be incorporated in the sizing composition), or in any layer on the photosensitive layer side of a support such as a photosensitive layer, a surface protective layer, an intermediate layer and an anti-halation layer, and can be added in one of or at least two of these layers.

Further, as a thioisocyanate type cross-linking agent applicable in this invention, compounds provided with thioisocyanate structures corresponding to the above isocyanates are also useful.

The using amount of the above cross-linking agent is generally 0.001-2 mol and preferably 0.005-0.5 mol, per 1 mol of silver.

Isocyanate compounds and thioisocyanate compounds, which can be incorporated in this invention, are preferably compounds which function as the above cross-linking agent; however, a preferable result can be obtained even by compounds provided with only one of said functional group.

Examples of a silane compound include compounds represented by formulas (1)-(3) disclosed in JP-A 2001-264930.

Further, epoxy compounds utilizable as a cross-linking agent is those provided with at least one epoxy group, and there are no limitation with respect to the number of epoxy groups, molecular weight and others. The epoxy group is preferably contained in the molecule as a glycidyl group via an ether bond or an imino bond. Further, epoxy compounds may be any of such as monomer, oligomer and polymer, and the number of epoxy groups existing in a molecule is generally approximately 1-10 and preferably 2-4. In the case of an epoxy compound being polymer, either homopolymer or copolymer may be employed, and the mean number average molecular weight Mn is specifically preferably in a range of approximately 2,000-20,000.

An acid anhydride utilized in this invention is a compound provided with at least one acid unhydride group represented by the following structural formula. There are no limitation with respect to the number of acid unhydride groups, the molecular weight and others, provided that having at least one such acid unhydride group.

—CO—O—CO—

The above epoxy compounds and acid anhydrides may be utilized alone or in combination of at least two types. The addition amount is not specifically limited, however, preferably in a range of $1\times10^{-6}$-$1\times10^{-2}$ mol/m$^2$ and more preferably $1\times10^{-5}$-$1\times10^{-3}$ mol/m$^2$. These epoxy compounds and acid anhydrides may be incorporated in any layer on the photosensitive layer side of a support such as a photosensitive layer, a surface protective layer, an intermediate layer, an antihalation layer and an under coat layer and can be added in one of or at least two of these layers.

(Silver Saving Agent)

In a photosensitive layer according to this invention, a silver saving agent can be incorporated. A silver saving agent utilized in this invention refers to a compound which can reduce the required amount of silver to obtain a predetermined silver image density.

Various mechanisms of this reducing function may be considered, however, a compound provided with a function to improve covering power of developed silver is preferred. Herein, covering power of developed silver refers to an optical density per unit amount of silver. This silver saving agent can be incorporated in a photosensitive layer, a photo-insensitive layer or in the both of the layers. Preferable examples of a silver saving agent include hydrazine derivative compounds, vinyl compounds, phenol derivatives, naphthol derivatives, quaternary onium compounds and silane compounds. Specific examples include silver saving agents disclosed in paragraphs "0195"-"0235" of JP-A 2003-270755.

Silver saving agents according to this invention are specifically preferably compounds represented by following formulas (SE1) and (SE2).

$Q_1$-NHNH-$Q_2$ Formula (SE1)

In above formula (SE1), $Q_1$ represents an aromatic group or a heterocyclic group which bonds with —NHNH-$Q_2$ at a carbon atom portion, and $Q_2$ represents a carbamoyl group, an acyl group, an alkoxycarbonyl group, an aryloxycarbonyl group, a sulfonyl group or a sulfamoyl group.

Formula (SE2)

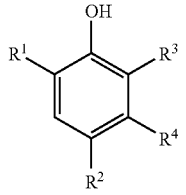

In above formula (SE2), $R^1$ represents an alkyl group, an acyl group, an acylamino group, a sulfonamide group, an alkoxycarbonyl group or a carbamoyl group. $R^2$ represents a hydrogen atom, a halogen atom, an alkyl group, an alkoxy group, an aryloxy group, an alkylthio group, an arylthio group, an acyoxy group or a carbonate ester group. $R^3$ and $R^4$ each represent groups which can be a substituent on a benzene ring. $R^3$ and $R^4$ may form a condensed ring by bonding each other.

In the case that $R^3$ and $R^4$ form a condensed ring by bonding each other in formula (SE2), a preferable condensed ring is a naphthalene ring. When formula (SE2) represents a naphthol type compound, $R^1$ is preferably a carbamoyl group. Among them, a benzoyl group is specifically preferable. $R^2$ is preferably an alkoxy group or an aryloxy group, and is specifically preferably an alkoxy group.

(Thermal Solvent)

A thermal solvent is preferably contained in a silver salt photothermographic dry imaging material of this invention. Herein, a thermal solvent is defined as a material which can lower the thermal development temperature of a silver salt photothermographic dry imaging material containing the thermal solvent by not less than 1° C. compared to a silver salt photothermographic dry imaging material containing no thermal solvent. More preferably it is a material being able to lower the thermal development temperature by not less than 2° C. and specifically preferably by not less than 3° C. For example, when a photothermographic dry imaging material containing a thermal solvent is A and a photothermographic dry imaging material containing no thermal solvent is B, a thermal solvent is defined with respect to the case, in which the thermal development temperature to obtain the density, which is obtained by exposing B and processing B at a thermal development temperature of 120° C. and a thermal development time of 20 seconds, by photothermographic dry imaging material A with the same exposure amount and the same thermal development time becomes not higher than 119° C.

A thermal solvent is provided with a polar group as a substituent and is preferably represented by formula (TS), however, is not limited thereto.

$(Y)_nZ$ Formula (TS)

In formula (TS), Y represents an alkyl group, an alkenyl group, an alkynyl group, an aryl group, or a heterocyclic group. Z represents a group selected from a hydroxyl group, a carboxy group, an amino group, an amido group, a sulfonamide group, a phosphoric acid amide group, a cyano group, imido, urido, sulfoxide, suphon, sulphine, phosphinoxide or a nitrogen-containing heterocyclic group. n represents an integer of 1-3; n is 1 when Z is monovalent, and is identical to the valence of Z when Z is a group having two or more valences. Plural number of Y may be same or different when n is not less than 2.

Y may be further provided with a substituent, which may be a group represented by Z. Y will be further detailed. In formula (TS), Y represents a straight chain, branched chain or cyclic alkyl group (having a carbon n umber of preferably 1-40, more preferably 1-30 and specifically preferably 1-25, and includes methyl, ethyl, n-propyl, iso-propyl, sec-butyl, t-butyl, t-octyl, n-amyl, t-amyl, n-dodecyl, n-tridecyl, octadecyl, icocyl, cyclopentyl and cyclohexyl), an alkenyl group (preferably having a carbon number of preferably 2-40, more preferably 2-30 and specifically preferably 2-25, and includes such as vinyl. allyl, 2-butenyl and 3-pentenyl), an aryl group (preferably having a carbon number of preferably 6-40, more preferably 6-30 and specifically preferably 6-25, and includes such as phenyl, P-methylphenyl and naphthyl), a heterocyclic group (preferably having a carbon number of preferably 2-20, more preferably 2-16 and specifically preferably 2-12, and includes such as pyridyl, pyradyl, imidazoyl and pyrrolidyl). These substituents may be further substituted by other substituent. Further, these substituents may form a ring by bonding to each other.

Y may be further provided with a substituent, and examples of the substituent include the substituents described in "0015" of JP-A 2004-21068. The reason why development becomes active by utilizing a thermal solvent is considered that a thermal solvent is fused at near development temperature to become compatible with substances related to development, which enables a reaction at a lower temperature compared to the case without a thermal solvent. Since thermal development is a reducing reaction in which carboxylic acid and a silver ion transporting substance, having a relatively high polarity, participate, it is preferable to form a reaction field provided with a suitable polarity by a thermal solvent having polarity.

A melting point of a thermal solvent preferably utilized in this invention is not lower than 50° C. and not higher than 200° C., and more preferably is not lower than 60° C. and not higher than 150° C. Such as the purpose of this invention, in a thermally developable photosensitive material which regards stability against outer environment such as image storage stability as important, preferred is a thermal solvent having a melting point of not lower than 100° C. and not higher than 150° C.

Specific examples of a thermal solvent include compounds described in "0017" of JP-A 2004-21068 and compounds described in "0027" of U.S. Patent Application Publication No. 2002/0025498; that is, compounds MF-1-MF-3, MF-6, MF-7, MF-9-MF-12 and MF-15-MF-22.

The addition amount of a thermal solvent in this invention is preferably 0.01-5.0 g/m$^2$, more preferably 0.05-2.5 g/m$^2$ and furthermore preferably 0.1-1.5 g/m$^2$. A thermal solvent is preferably incorporated in a photosensitive layer. Further, the above thermal solvents may be utilized alone or in combination of at least two types. In this invention, a thermal solvent may be incorporated in a coating composition by any method such as a solution form, a emulsified dispersion form and a solid micro-particle dispersion form, to be contained in a photosensitive material.

Emulsifying dispersion methods well known include a method to mechanically prepare an emulsified dispersion by dissolution utilizing an auxiliary solvent such as dibutylphthalate, tricresylphosphate, glycryltriacetate or diethylphthalate.

Further, a solid micro-particle dispersion method includes a method in which a powder of a thermal solvent is dispersed in an appropriate solvent such as water by use of a ball mill, a vibration-ball mill, a sand mill, a jet mill, a roller mill or ultrasonic wave to prepare a solid dispersion. Herein, at that time, a protective colloid (such as polyvinyl alcohol) and a surfactant (anionic surfactant such as sodium triisopropylnaphthalenesulfonate (a mixture of three compounds isopropyl groups of which substitute at different positions)) may be utilized. In the above mills, beads such as zirconia are generally utilized, and such as Zr dissolved from these beads may be mixed in the dispersion. The concentration depends on a dispersion conditions, however, is generally in a range of 1-1000 ppm. It is not practically problematic, when a content of Zr in a photosensitive material is not more than 0.5 mg per 1 g of silver. An antiseptic agent (such as benzoisothiazolinone sodium salt) is preferably incorporated in the water dispersion.

[Antifoggant and Imge Stabilizer]

In any of constituent layers of a silver salt photothermographic dry imaging material of this invention, an antifoggant to prevent fog generation during storage before thermal development and an image stabilizer to prevent image deterioration after thermal development are preferably incorporated.

Antifoggants and image stabilizers employed in a silver salt photothermographic dry imaging material of this invention will now be explained.

Since a reducing agent is provided with a proton primarily such as bisphenols and sulfonamide phenols as a reducing agent according to this invention, it is preferred to incorporate a compound which is able to inactivate these hydrogen and to prevent a reaction to reduce silver ion. Further, it is preferable to incorporate a compound which is capable of oxidation bleaching of a silver atom or metal silver (silver cluster) generated during storage of raw film or images.

Specific examples of compounds provided with these functions include various antifoggants and image stabilizers, for example, biimidazolyl compounds, iodonium compounds and compounds, which can release a halogen atom as an active species, such as described in paragraphs "0096"-"0128" of JP-A 2003-270755; polymer provided with at least one monomer repeating unit having a halogen radical releasing group such as described in JP-A 2003-91054; vinyl sulfones and/or β-halosulfone and vinyl type restrainers such as described in paragraph "0013" of JP-A 6-208192.

A silver salt photothermographic dry imaging material of this invention forms a photographic image by thermal development process, and is preferably contain a toning agent (a toner) to appropriately adjust tone of silver in a state of generally being dispersed in a (organic) binder matrix.

Examples of suitable toning agents utilized in this invention are disclosed in RD 17029, U.S. Pat. Nos. 4,123,282, 3,994,732, 3,846,136 and 4,021,249, and include the following.

Listed are imides (such as succinimide, phthalimide, naphthalimide, N-hydroxy-1,8-naphthalimide), mercaptanes (such as 3-mercapto-1,2-triazole), phthalazine derivatives or metal salts thereof (such as phthalazinone, 4-(1-naphthyl) phthalazinone, 6-chlorophthalazinone, 5,7-dimethyloxyphthalazinone and 2,3-dihydro-1,4-phthalazinedione), combinations of phthalazine and phthalic acids (such as phthalic acid, 4-methylphthalic acid, 4-nitrophthalic acid and tetrachlorophthalic acid), combinations of phthalazine and at least one conmpound selected from maleic acid abhydride, an phthalic acid, 2,3-naphthalene dicarboxylic acid or o-phenylene acid derivatives and anhydrides thereof (such as phthalic acid, 4-methyl phthalic acid, 4-nitrophtahlic acid and tetrachloro phthalic acid anhydride). Specifically preferable toner is a combination of phthalazinone or phtahlazine and phthalic acids or phthalic acid anhydrides.

(Fluorine-Type Surfactant)

In this invention, to improve film transport characteristics in a laser imager (thermal development apparatus) and environmental adaptability (minimum accumulation in a humane body), a fluorine-type surfactant represented by following formula (SF) is preferably utilized.

$$(R_f\text{-}(L)_n\text{-})_p\text{-}(Y)_m\text{-}(A)_q \qquad \text{Formula (SF)}$$

In above formula (SF), $R_f$ represents a substituent containing a fluorine atom; L represents a divalent connecting group provided with no fluorine atom; Y represents a (p+q)-valent connecting group provided with no fluorine atom; A represents an anionic group or salt thereof; n and m each represent 0 or 1; p represent an integer of 1-3; and q represent an integer of 1-3. However, n and m are never simultaneously 0, when q is 1.

In formula (SF), $R_f$ represents a substituent containing a fluorine atom, and said substituent containing a fluorine atom includes a fluoroalkyl group having a carbon number of 1-25 (such as a trifluorometyl group, a trifluoroethyl group, a perfluoroethyl group, a perfluorobutyl group, a perfluorooctyl group, a perfluorododecyl group and a perfluorooctadecyl group), or a fluoroalkenyl group (such as a perfluoropropenyl group, a perfluorobutenyl group, a perfluorononenyl group and a perfluorododecenyl group). $R_f$ is preferably provided with a carbon number of 2-8 and more preferably of 2-6. Further, $R_f$ is preferably provided with a fluorine atom number of 2-12 and more preferably of 3-12.

L represents a divalent connecting group having no fluorine atom, and said divalent connecting group having no fluorine atom includes, for example, an alkylene group (such as a methylene group, an ethylene group and a butylene group), an alkyleneoxy group (such as a methyleneoxy group, an ethyleneoxy group and a butylenesoxy group), an oxyalkylene group (such as an oxymethylene group, an oxyethylene group and an oxybutylene group), an oxyalkyleneoxy group (such as an oxymethyleneoxy group, an oxyethyleneoxy group and an oxyehtyleneoxyethyleneoxy group), a phenylene group, an oxyphenylene group, a phenyleneoxy group, an oxyphenyloxy group or combination groups thereof.

A represents an anionic group or a salt thereof and includes carboxylic acid or a salt thereof (sodium salt, potassium salt and lithium salt), sulfonic caid or salt thereof (sodium salt, potassium salt and lithium salt), sulfonic acid half ester or salt thereof (sodium salt, potassium salt and lithium salt) and phosphoric acid or salt thereof (such as sodium salt and potassium salt).

Y represents a (p+q) valent connecting group containing no fluorine atom, and, for example, 3- or 4-valent connecting group containing no fluorine atom includes atomic groups constituted of a nitrogen atom or a carbon atom as a center atom. n is 0 or 1 and is preferably 1.

Fluorine-type surfactants represented by formula (SF) can be prepared by further introducing an anionic group (A) by such as sulfuric acid esterification into a compound, which has been prepared by an addition reaction or condensation reaction of an alkyl compound having a carbon number of 1-12 introduced with a fluorine atom (a compound provided with such as a trifluoromethyl group, a pentafluoroethyl group, a perfluorobutyl group and a perfluorooctadecyl group), an alkenyl compound (a compound provided with such as a perfluorohexenyl group and a perfluorononenyl group), an alkanol compound having a 3-6 valency without being introduced with a fluorine atom and an aromatic compound or hetero compound having 3-4 hydroxyl groups.

The above alkanol compounds having 3-6 valency include such as glycerin, pentaerithritol, 2-methl-2-hydroxymethyl-1,3-propanediol, 2,4-dihydroxy-3-hydroxymethylpentene, 1,2,6-hexatriol, 1,1,1-tris(hydroxymethyl)propane, 2,2-bis(butanol)-3-aliphatic triol, tetramethirolmethane, D-sorbitol, xylitol and D-mannitol.

The above aromatic compounds and hetero compounds, which are provided with 3-4 hydroxyl groups, include such as 1,3,5-trihydroxybenzene and 2,4,6-trihydroxypyridine.

Preferable specific examples of fluorine-type surfactants represented by grneral formula (SF) are shown below.

SF-1

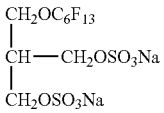

SF-2

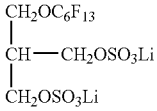

-continued

SF-3

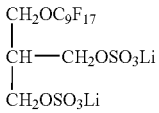

SF-4

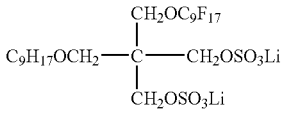

SF-5

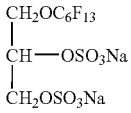

SF-6

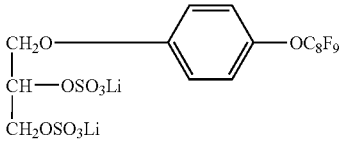

SF-7

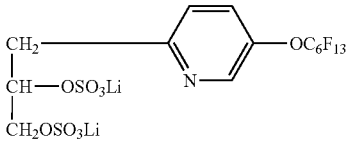

SF-8

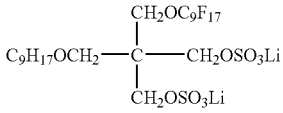

SF-9

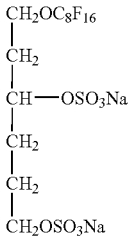

SF-10

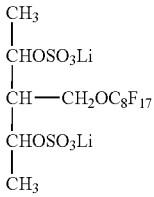

SF-11

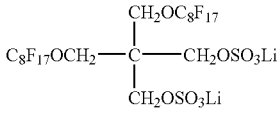

-continued

SF-12

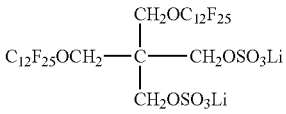

SF-13

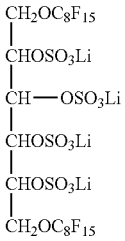

SF-14

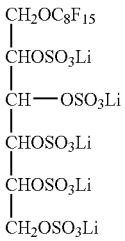

SF-15

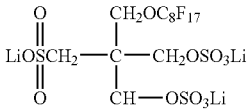

SF-16

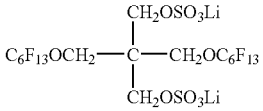

SF-17

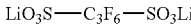

SF-18

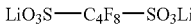

SF-19

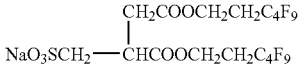

SF-20

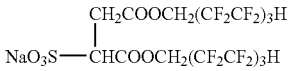

SF-21

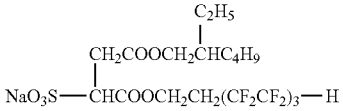

A fluorine-type surfactant represented by formula (SF) of this invention can be added into a coating composition according to a method well known in the art. That is, it can be added by being dissolved in such as a polar solvent like alcohols such as methanol and ethanol, ketones such as methyl ethyl ketone and acetone, dimethylsulfoxide, and dimethylfolmamide. Further, it can be added also by being dispersed as micro-particles having a particle size of not more than 1 μm in water or an organic solvent by means of sand mill dispersion, jet mill dispersion, ultrasonic dispersion or homogenizer dispersion. Many technologies have been disclosed with respect to micro-particle dispersion, and dispersion can be carried out according to these technologies. A fluorine-type surfactant represented by formula (SF) is preferably incorporated in the outermost protective layer.

The addition amount of a fluorine-type surfactant represented by formula (SF) of this invention is preferably $1\times10^{-8}$-$1\times10^{-1}$ mol and more preferably $1\times10^{-5}$-$1\times10^{-2}$ mol, per 1 $m^2$. When it is less than the aforesaid range, an antistatic property may not be obtained, while when it is over the aforesaid range, temperature dependence may become large resulting in deterioration of storage stability under high humidity.

[Surface Layer, Surface Physical Property Controlling Agent, etc.]

A silver salt photothermographic dry imaging material of this invention may often subjected to unfavorable effects by contact of various apparatus and a silver salt photothermographic dry imaging material or of silver salt photothermographic dry imaging materials each other such as between a photosensitive front layer and a backing layer, at the time of windup, rewind and transportation of said photosensitive material in manufacturing processes such as coating, drying and processing. For example, they are such as generation of scratches and abrasions on said photosensitive material surface, and deterioration of transport behavior of said photosensitive material in such as a development apparatus.

Therefore, in a silver salt photothermographic dry imaging material, to prevent surface abrasion and poor transportation behavior described above, it is preferable to adjust physical properties of said material by containing such as a lubricant and a matting agent in any of the constituent layers and, particularly, in the outermost layer on a support, of said material.

In a silver salt photothermographic dry imaging material of this invention, it is preferable that organic solid lubricant particles having a mean particle size of 1-30 μm are contained in the outermost layer on a support and the organic solid lubricant particles are dispersed by a polymer dispersant. Further, the melting point of said organic solid lubricant particles is preferably higher than the thermal development temperature; it is preferably not lower than 80° C. and more preferably not lower than 110° C.

Organic solid lubricant particles utilized in a silver salt photothermographic dry imaging material of this invention is preferably a compound which lowers the surface energy and includes particles formed by grinding such as polyethylene, polypropylene, polytetrafuluoroethylene and copolymer thereof.

In the following, examples of organic solid lubricant particles will be shown, however, this invention is not limited thereto.

| | | [melting point ° C.] |
|---|---|---|
| PW-1 | Polytetrafuluoroethylene | 321° C. |
| PW-2 | Polypropylene/polyethylene copolymer | 142° C. |
| PW-3 | Polyethylene (low density) | 113° C. |
| PW-4 | Polyethylene (high density) | 126° C. |
| PW-5 | Polypropylene | 145° C. |

In a silver salt photothermographic dry imaging material of this invention, compounds represented by following formula (1) are specifically preferred as organic solid lubricant particles.

$$(R_1)_p—X_1\text{-}L\text{-}X_2—(R_2)_q \qquad \text{Formula (1)}$$

In above formula (1), $R_1$ and $R_2$ each represent an alkyl group, an alkenyl group, an alalkyl group or an aryl group, which may be substituted or unsubstituted and is provided with a carbon number of 6-60, and plural of $R_1$'s and $R_2$'s may be identical to or different from, each other, when p or q is not less than 2. $X_1$ and $X_2$ each represent a divalent connecting group containing a nitrogen atom. L represents a substituted or unsubstituted (p+q)-valent alkyl group, alkenyl group, alalkyl group or aryl group.

In a silver salt photothermographic dry imaging material of this invention, at least one layer on a support preferably contains a compound represented by aforesaid formula (1) together with a nonionic fluorine-containing surfactant and an anionic fluorine-containing surfactant.

Nonionic fluorine-containing surfactants utilized in this invention are not specifically limited, however, are preferably compounds represented by following formula (A).

$$Rf_1\text{-}(AO)_n\text{-}Rf_2 \qquad \text{Formula (A)}$$

wherein, $Rf_1$ and $Rf_2$ represent a fluorine-containing aliphatic group and may be identical to or different from, each other. AO represents a group having at least one alkyleneoxy group, and n represents an integer of 1-30.

(Dyes and Pigments)

In a silver salt photothermographic dry imaging material of this invention, to control the quantity or wavelength distribution of light to pass through a photosensitive layer, it is preferable to form a filter layer on the photosensitive layer side or on the opposite side or to incorporate dye or pigment in a photosensitive layer.

As dyes, utilized can be compounds well known in the art and absorbs light in various wavelength regions depending on the spectral sensitivity of the photosensitive material.

For example, in the case of utilizing silver salt photothermographic dry imaging material of this invention as an image recording material by infrared light, it is preferable to utilize squalilium dyes provided with a thiopyrilium nuclei (also referred to as a thiopyrilium squalilium dye) and squalilium dyes provided with a pyrilium nuclei (also referred to as a pyrilium squalilium dye), or thiopyriliumcroconium dyes or pyriliumcroconium dyes similar to a squalilium dye, disclosed in JP-A 2001-83655.

Herein, a compound provided with a squalilium nuclei is a compound provided with 1-cyclobutene-2-hydroxy-4-one in the molecular structure, and a compound provided with a croconium nuclei is a compound provided with 1-cyclopentene-2-hydroxy-4,5-dione in the molecular structure. Herein, a hydroxyl group may be dissociated. Hereinafter in this publication, these dyes are called as a squalilium dyes, in one lump for convenience. And, preferable dyes also include compounds of JP-A 8-201959.

(Support)

As a material of a support utilized in a silver salt photothermographic dry imaging material includes such as various types of polymer materials, glass, wool cloth, cotton cloth, paper, metal (such as aluminum), however, a flexible sheet or materials capable of being processed into a roll is suitable, with respect to handling as a information recording material. Therefore, as a support in a photosensitive material of this invention, preferable is plastic films such as cellulose acetate film, polyester film, polyethylene terephthalate (PET) film, polyethylene naphthalate (PEN) film, polyamide film, polyimide film, cellulose triacetate film (TAC) or polycarbonate film (PC), and bi-axially stretched PET is specifically preferred. The thickness of a support is approximately 50-300 μm and preferably 70-180 μm.

To improve charging property, conductive compounds such as a metal oxide and/or a conductive polymer can be incorporated in a constituting layer. These may be incorporated in any layer, however, preferably in a backing layer, or a surface protective layer or an under coat layer on the image forming layer side. Such as conductive compounds, described in columns 14-20 of U.S. Pat. No. 5,244,773, are preferably utilized. Among them, in this invention, it is preferable to incorporate a conductive metal oxide compound in a surface protective layer of the backing layer side.

Herein, a conductive metal oxide is crystalline metal oxide particles and such as those containing oxygen defects and a small amount of a hetero atom which forms a donor against utilized metal oxide are specifically preferable, generally speaking, because of high conductivity, and the latter is specifically preferable because it provides no fog to silver halide emulsion. Examples of a metal oxide is preferably such as ZnO, $TiO_2$, $SnO_2$, $AL_2O_3$, $In_2O_3$, $SiO_2$, MgO, BaO, $MoO_3$ and $V_2O_5$ and complex oxides thereof, and specifically preferably ZnO, $TiO_2$ and $SnO_2$. As examples containing a hetero atom, addition of such as Al and In to ZnO, addition of such as Sb, Nb, P and a halogen element to $SnO_2$, and addition of such Nb and Ta to $TiO_2$ are effective. The addition amount of these hetero atoms is in a range of preferably 0.01-30 mol % and specifically preferably 0.1-10 mol %. Further, a silicon compound may be added at the time of micro-particle preparation to improve micro-particle dispersibility and transparency.

Metal oxide micro-particles utilized in this invention are provided with conductivity, and the volume specific resistance is preferably not more than $10^7$ Ω·cm and specifically preferably not more than $10^5$ Ω·cm. These oxides are described in such as JP-A Nos. 56-143431, 56-120519 and 58-62647. In addition to these, utilized may be conductive materials, in which the above-described metal oxide adheres to other crystalline metal oxide particles or fiber form substances (such as titanium oxide), as described in Examined Japanese Patent Application Publication No. 59-6235.

The particle size utilized is preferably not more than 1 μm; however, the stability after dispersion is excellent to be easily handled when it is not more than 0.5 μm. Further, when conductive particles of not more than 0.3 μm are utilized to minimize light scattering, it is specifically preferable because a transparent photosensitive material can be prepared. Further, when the conductive metal oxide is a needle-form or a fiber-form, a length of not more than 30 μm and a diameter of not more than 1 μm are preferable, and a length of not more than 10 μm, a diameter of not more than 0.3 μm and a length/diameter ratio of not less than 3 are specifically preferable. Herein, $SnO_2$ is available on the market from Ishihara Sangyo Kaisha, Ltd., and utilized can be such as SNS-10M, SN-100P, SN-100D and FSS-10M.

[Constituent Layers]

A silver salt photothermographic dry imaging material of this invention is provided with at least one photosensitive layer as an image forming layer on a support. Only a photosensitive layer may be formed on a support, however, it is preferable to form at least one photo-insensitive layer on the photosensitive layer. For example, a protective layer is preferably provided on a photosensitive layer for the purpose of protecting the photosensitive layer, and a back-coat layer is preferably provided on the opposite side of a support to prevent "adhesion" between photosensitive materials each other or between a photosensitive material and a roller.

A binder utilized in these protective layer and back-coat layer is selected from polymers, having a glass transition temperature (Tg) of higher than that of a photosensitive layer and being difficult to generate abrasion or deformation, such as cellulose acetate, cellulose acetatebutyrate and cellulose acetatepropionate.

Herein, for such as gradation control, at least two layers on the one side of a support, or at least each one layer on the both sides of a support, of photosensitive layers may be arranged.

[Coating of Constituent Layers]

A silver salt photothermographic dry imaging material of this invention is preferably formed by preparing coating compositions, in which above-described materials of each constituent layer are dissolved or dispersed in a solvent, and by performing a heating treatment after the coating compositions having been simultaneously multi-coated. Herein, "simultaneous multi-coating" means that a coating composition of each constituent layer is prepared and each constituent layer (such as a photosensitive layer and a protective layer) is formed by simultaneously multilayer-coating under a state of also capable of being dried simultaneously without repeating coating-drying for each separate layer, at the time of coating the solution on a support. That is, to provide an upper layer before a residual amount of the total solvent in the under layer becomes not more than 70 weight % (more preferably not more than 90 weight %).

A simultaneous multi-layer coating method of each constituent layer is not specifically limited, and such as a bar coater method, a curtain coat method, an immersion method, an air-knife method, a hopper coat method, a reverse roll coat method, a gravure coat method and an extrusion coat method can be utilized.

More preferable among these are a slide coat method and an extrusion coat method. These coating methods were described with respect to the side provided with a photosensitive layer, however, it is similar also in the case of preparing a back-coat layer which is coated together with an under coat layer. As for a simultaneous multi-layer coating method in a photothermographic dry imaging material is detailed in JP-A 2000-15173.

Herein, in this invention, the coating weight of silver is suitably selected depending on purposes of silver salt photothermographic material, however, in the case of images for medical application, it is preferably 0.3-1.5 g/m$^2$ and more preferably 0.5-1.5 g/m$^2$. Among said coating weight of silver, that arising from silver halide occupies preferably 2-18 weight % and more preferably 5-15 weight %, against the total silver weight.

Further, in this invention, the coating density of silver halide grains of not smaller than 0.01 μm (as an equivalent spherical particle diameter) is preferably $1\times10^{14}$-$1\times10^{18}$ particles/m$^2$ and more preferably $1\times10^{15}$-$1\times10^{17}$ particles/m$^2$.

Further, the coating density of photo-insensitive silver long chain aliphatic carboxylate is preferably $1\times10^{-17}$-$1\times10^{-14}$ g and more preferably $1\times10^{-16}$-$1\times10^{-15}$ g per one particle of silver halide grain of not smaller than 0.01 μm (as an equivalent spherical particle diameter).

In the case of coating being performed under the conditions in the above range, a preferable result is obtained with respect to an optical maximum density of silver image per a predetermined coated silver weight, that is with respect to a silver covering amount (covering power) and tone of a silver image.

In this invention, a solvent is preferably contained at a range of 5-1,000 mg/m$^2$ in a silver salt phothtermographic dry imaging material at the time of thermal development. It is more preferably adjusted to 10-150 mg/m$^2$. Thereby, it is possible to prepare a thermally developable photosensitive material which exhibits high sensitivity, low fog and high density. The solvent includes those described in paragraph "0030" of JP-A 2001-264930; however, this invention is not limited thereto. Further, these solvents can be utilized alone or in combination of a few types.

The content of the above solvent in a thermally developable photosensitive material can be adjusted by changing the conditions of such as temperature in such as a drying process after a coating process. Further, the content of said solvent can be measured by means of gas chromatography under conditions suitable to detect the containing solvent.

[Technologies to Prevent Odor and Contamination]

Preferable embodiments as a technology to decrease or prevent odor or contamination, which arise from evaporation of such as a compound having a low molecular weight from a silver salt phothtermographic dry imaging material of this invention in a thermal development apparatus (a laser imager) at the time of thermal development of said material, will now be explained.

In a silver salt photothermographic dry imaging material of this invention, a protective layer is preferably provided with a function to prevent contaminating substances, which are generated during thermal development, from evaporating toward or adhering to the outside of said photosensitive material. For this purpose, a protective layer binder is preferably cellulose acetate having an acetylation degree of not less than 50% and not more than 58% or polymer provided with a vinyl alcohol unit having a saponification degree of not more than 75%, and specifically preferably vinyl acetate polymer and polyvinyl alcohol.

Cellulose acetate is preferably has a acetylation degree of not less than 50% and not more than 58%. While, polyvinyl alcohol is preferably lower crystallizing polyvinyl alcohol having a saponification degree of not more than 75%. The lower limit of the saponification degree is preferably 40% and more preferably 60%.

Further, in a protective layer, polymers other than those described above, such as described in U.S. Pat. Nos. 6,352,819, 6,352,820 and 6,350,561 can be utilized in combination with the aforesaid polymers. The ratio is preferably 0-90 volume % and more preferably 0-40 volume %.

As a cross-linking agent for the above binders, an isocyanate type compound, a silane compound, an epoxy compound or an acid anhydride is preferred.

Further, it is preferable to decrease substance amount being evaporated from said photosensitive material at development by utilizing an acid scavenger. Acid scavengers include an isocyanate type represented by following formula (X-1), an epoxy type represented by following formula (X-2), a phenol type represented by following formula (X-3) and an amine type or a diamine type represented by following formula (X-1), and a carbodiimide type.

Formula (X-1)

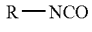

Formula (X-2)

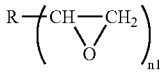

Formula (X-3)

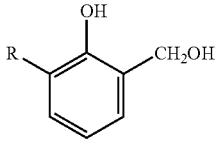

-continued

Formula (X-4)

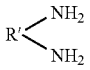

In above formulas (X-1)-(X-4), R-represents a substituent; R' represents a divalent connecting group; and n1 represents 1-4.

(Exposure Conditions)

With respect to exposure utilized in a silver salt photothermographic dry imaging material of this invention, or exposure in a image forming method of this invention, various conditions concerning such as a light source and exposure time suitable to obtain an aimed appropriate image can be employed.

A silver salt photothermographic dry imaging material preferably employs a laser light at the time of image recording. Herein, a light source suitable to the spectral sensitivity, with which said photosensitive material is provided, is preferably utilized. For example, in the case of said photosensitive material being prepared to be sensitive to infrared light, any light source of infrared light is applicable; however, an infrared semiconductor laser (780 nm, 820 nm) is preferably utilized with respect to a high laser power and forming a transparent silver salt photothermographic dry imaging material.

Further, a photothermographic dry imaging material of this invention particularly exhibits the characteristics by being exposed with a light preferably having a high illuminance of not less than 1 $mW/mm^2$ in a short time. Herein, the illuminance refers to an illuminance at which a photosensitive material provides an optical density of 3.0. When an exposure is performed at such a high illuminance, a light amount (=illuminance×exposure time) necessary to obtain a required density can be made small, resulting in enabling a design of a high sensitive system. It is more preferably 2 $mW/mm^2$-50 $W/mm^2$ and is most preferably 10 $mW/mm^2$-50 $W/mm^2$.

Provided being such a light source described above, any light source can be employed; however, laser light can achieve an excellent result. As a laser light preferably utilized, a gas laser (Ar ion, Kr ion, He—Ne), a YAG laser, a dye laser and a semiconductor laser are preferable. Further, a semiconductor laser in combination with a second-harmonic generating element may be also utilized. Further, a semiconductor laser of blue-violet emitting light (such as having the peak strength at a wavelength in 350-440 nm) can be utilized. A blue-violet emitting high output power laser includes NLHV 3000E semiconductor laser, manufactured by Nichia Chemicals Co., Ltd.

In this invention, exposure is performed preferably by means of laser scanning exposure; however, various methods can be applied as the exposing method. For example, the first preferable method include a method to utilize a laser scanning exposing apparatus in which the angle between the exposure surface of a photosensitive material and the scanning laser light does never become essentially perpendicular.

Herein, "never become essentially perpendicular" refers to that the angle nearest to perpendicular during laser scanning exposure is preferably 55-88 degrees, more preferably 60-86 degrees, furthermore preferably 65-84 degrees and most preferably 70-82 degrees.

The beam spot diameter on the exposure surface of a photosensitive material at the time of laser light being scanned on the photosensitive material is preferably not more than 200 μm and more preferably not more than 100 μm. This is because the smaller is the spot diameter, it is preferable with respect to decreasing "a deviation angle" from perpendicular of laser light incident angle. Herein, the minimum of the beam spot diameter is 10 μm. By performing such a laser scanning exposure, it is possible to depress image quality deterioration due to reflection light such as generation of unevenness of an interference fringes form.

Further, as the second method, exposure is also preferably performed by use of a laser scanning exposure apparatus which emits scanning laser light of a lateral multi-mode. Lateral multi-mode scanning laser light decreases image quality deterioration such as generation of unevenness of an interference fringes form, compared to lateral single-mode scanning laser light. To make lateral multiple, preferable are methods of such as to employ combined waves, utilizing returning light, and applying high frequency accumulation. Herein, lateral multi-mode means the exposure wavelength is not single and generally the distribution of exposure wavelength is made to be not less than 5 nm and preferably not less than 10 nm. The upper limit of the distribution of exposure wavelength is not specifically limited; however, is generally approximately 60 nm.

Further, as the third embodiment, it is also preferable to form an image by scanning exposure employing at least two sets of laser light. Such an image recording method employing plural sets of laser light is a technique utilized as an image writing means in a laser printer and a digital copier to write plural lines per each one time scanning, with respect to requirement of high resolution and high speed, and disclosed in such as JP-A 60-166916. This is a method in which laser light emitted from a light source unit is inclination scanned by use of a polygon mirror and focused on a photoreceptor through such as an fθ lens, which is a laser scanning exposure apparatus principally same as a laser imager.

In focusing of laser light on a photosensitive element in an image writing means of a laser printer and a digital copier, the next laser light is focused at the position being shifted by one line from the focused position of one laser light for the purpose of writing plural lines of an image per one time scanning. Specifically, two light beams are adjacent to each other in a vertical scanning direction at an interval of a few 10 μm order on an image surface, and the vertical scanning direction pitch of 2 beams is 63.5 μm when the printing density is 400 dpi (dpi is a dot number per 1 inch=2.54 cm), and is 42.3 μm when the printing density is 600 dpi. Different from such a method in which laser light is shifted by an amount of one resolution in the vertical scanning direction, in this invention, an image is preferably formed by condensing at least two sets of laser on the same place of the exposure surface at different incident angles. At this time, it is preferable to set the condition to satisfy $0.9\times E \leqq En\times N \leqq 1.1\times E$, when an exposure energy in the case that writing is generally performed with one set of laser light (wavelength of λ (nm)) is E, and N sets of laser light utilized for exposure have the same wavelength (wavelength of λ (nm)) and same exposure energy (En). By setting such a condition, the energy on the exposure surface is assured while reflection of each laser light on an image forming layer is decreased due to lower exposure energy of the laser resulting in depression of generation of interference fringes.

Herein, in the above description, the plural sets of laser light, wavelengths of which are identical, are utilized; however, those provided with different wavelengths can be also utilized. In the latter case, with respect to λ nm, it is preferable to set the condition to satisfy $(\lambda-30)<\lambda 1, \lambda 2, \ldots \lambda n \leqq (\lambda+30)$.

Herein, in the aforesaid first, second and third embodiments of image recording methods, as a laser utilized for scanning exposure, commonly known lasers; solid lasers such as a ruby laser, a YAG laser, and a glass laser; gas lasers such as a He—Ne, an Ar ion laser, a Kr ion laser, a $CO_2$ laser, a CO laser, a He—Cd laser, a $N_2$ laser and an excimer laser; semiconductor lasers such as an InGaP laser, an AlGaAs laser, a GaAsP laser, an InGaAs laser, an InAsP laser, a $CdSnP_2$ laser and a GaSb laser; chemical lasers and dye lasers can be utilized by appropriate selection corresponding to application purposes. Among them, laser light by a semiconductor laser having a wavelength of 600-1200 nm is preferably utilized with respect to maintenance and the size of a light source. Further, in laser light utilized in a laser imager and a laser image setter, the beam spot diameter at the time of being scanned on a silver salt photothermographic dry imaging material is generally 5-75 μm as a shorter axis diameter and 5-100 μm as a longer axis diameter on said material surface, and the laser light scanning speed can be set to the most suitable value for each photothermographic dry imaging material depending on sensitivity at a laser emission wavelength characteristic to the silver salt photothermographic dry imaging material and laser power.

[Laser Imager, Development Conditions]

A laser imager (a thermal development apparatus) referred to in this invention is constituted of a film feeding apparatus section represented by a film tray, a laser image recording apparatus section, a thermal development section which supplies uniform and stable heat to the whole surface of a silver salt photothermographic dry imaging material and a transport section which is extended from a film feeding section via a laser recording until sending out of a photothermographic dry imaging material outside the apparatus.

It is preferable to make a time interval between an exposure process and a thermal development process short for a rapid processing. Further, it is preferable to simultaneously advance an exposure process and a thermal development process. That is, to initiate and advance development of an already exposed portion is started while exposing a part of a sheet form silver salt photothermographic dry imaging material, it is preferable to arrange the distance between an exposure section to perform an exposure process and a development section to be not less than 0 cm and not mor ethan 50 cm, and thereby a series of processing time from exposure to development can be made very short. The preferable range of the distance is not less than 3 cm and not more than 40 cm and more preferably not less than 5 cm and not more than 30 cm.

Herein an exposure section refers to a position where light from an exposure light source is irradiated on a silver salt photothermographic material, and a development section refers to a position where a silver salt photothermographic dry imaging material is firstly heated.

Herein, the transport speed of a silver salt photothermographic dry imaging material is 20-200 mm/sec and specifically preferably 30-150 mm/sec. By setting the transportation speed in this range, density unevenness at the time of thermal development can be minimized and application for diagnosis in emergency is possible due to a reduced processing time.

The development condition of a silver salt photothermographic dry imaging material will vary depending on equipment, an apparatus or a means which are utilized, however, typically, development is performed by heating an imagewise exposed photothermographic dry imaging material at a suitable high temperature. Development is performed at a temperature of approximately 80-200° C., preferably of approximately 100-140° C. and more preferably of 110-130° C.; and preferably for 3-20 seconds and more preferably for 5-12 seconds.

A silver salt photothermographic dry imaging material provided with a protective layer on a photosensitive layer is preferably heat processed by bringing the surface side having a protective layer in contact with a heating means with respect to uniform heating as well as such as a heat efficiency and workability, and is more preferably developed by being heat processed while the surface side having a protective layer is brought in contact with a heat roller.

In a silver salt photothermographic dry imaging material of this invention, an image which is obtained by heat development at a heating temperature of 123° C. and a development time of 10 seconds, preferably has a mean gradation of 2.0-4.0 for optical diffuse density of 0.25-2.5, based on a characteristic curve shown on a right-angled coordinate having an identical unit length of diffuse density (Y-axis) and common logarithmic exposure quantity (X-axis). By setting the gradation in this range, it is possible to obtain an image having a high diagnostic recognition even with a small amount of silver.

EXAMPLES

Example 1

In the following paragraphs, this invention will be detailed with reference to examples, however, is not limited thereto. Herein, "part(s)" or "%" in examples represents "weight: part(s)" or "weight %", unless otherwise mentioned.

Example 1

<Synthesis of Polymers A, B and C>

A 4-necked separable flask of 0.3 liter equipped with a titration device, a thermometer, a nitrogen gas introducing tube, a stirrer and a reflux condenser was charged with 20 g of methyl ethyl ketone, and was heated to a temperature described in Table 1. Further, monomer having the composition described in Table 1 was weighed, subsequently, a mixed solution, in which 2 g of N,N-azobisisovaleronitrile was added into the aforesaid monomer, was titrated over 2 hours into the flask, and the solution was reacted for 5 hours. Thereafter, 80 g of methyl ethyl ketone were added to the solution to be cooled, resulting in preparation of polymer solutions A, B and C having a polymer content of 50 weight %. The molecular weight was determined as a polystyrene conversion weight average molecular weight by means of GPC.

TABLE 1

| | Polymer A | Polymer B | Polymer C |
|---|---|---|---|
| Monomer component | g | g | g |
| DAAM | 10 | 10 | 10 |
| Aam | 2 | 2 | 1 |
| PSE-400 | 4 | 4 | 4 |
| PME-400 | 4 | 4 | 5 |
| Charging temperature | 70° C. | 50° C. | 70° C. |
| Molecular weight | 80,000-90,000 | 50,000-60,000 | 80,000-90,000 |

g: gram

Blemmer PME-400: methacrylate provided with $-(EO)_m-CH_3$ (m is approximately 9)

Blemmer PSE-400: methacrylate provided with $-(EO)_m-C_{18}H_{37}$ (m is approximately 9)

(EO: an ethyleneoxy group)

Those described above are all produced by NOF Corp.

Aam: acrylamide

DMMA: diacetone acrylamide (produced by Kyowa Hakko Kogyo Co., Ltd.)

<Preparation of Silver Halide Emulsion>

<Preparation of Silver Halide Emulsion 1>

| | |
|---|---|
| (Solution A1) | |
| Phenyl carbamoyl gelatin | 88.3 g |
| Compound A (*1) (10% methanol aqueous solution) | 10 ml |
| Potassium bromide | 0.32 g |
| Water to make | 5429 ml |
| (Solution B1) | |
| 0.67 mol/L silver nitrate aqueous solution | 2635 ml |
| (Solution C1) | |
| Potassium bromide | 51.55 g |
| Potassium iodide | 1.47 g |
| Water to make | 660 ml |
| (Solution D1) | |
| Potassium bromide | 154.9 g |
| Potassium iodide | 4.41 g |
| $K_3IrCl_6$ ($4 \times 10^{-5}$ mol/Ag equivalent) | 50.0 ml |
| Water to make | 1982 ml |
| (Solution E1) | |
| 0.4 mol/L potassium bromide aqueous solution | An amount to controlling later-mentioned silver potential |
| (Solution F1) | |
| Potassium hydroxide | 0.71 g |
| Water to make | 20 ml |
| (Solution G1) | |
| 56% acetic acid aqueous solution | 18.0 ml |
| (Solution H1) | |
| Sodium carbonate unhydride | 1.72 g |
| Water to make | 151 ml |

(*1) Compound A: $HO(CH_2CH_2O)_n(CH(CH_3)CH_2O)_{17}(CH_2CH_2O)_mH$ (m + n = 5-7)

Employing a mixing stirrer described in Examined Japanese Patent Publication No. 58-58288, added to solution A1 were ¼ solution B1 and total solution C1 over 4 minutes 45 seconds utilizing a double-jet method, while adjusting the temperature to 4.5° C. and the pAg to 8.09, whereby nuclei were formed. After 1 minute all of solution F1 was added. Meanwhile pAg was appropriately adjusted by employing solution E1. After 6 minutes, added to the resulting mixture were ¾ solution B1 and all of solution D1 over 14 minutes 15 seconds employing a double-jet method, while adjusting the pAg to 8.09. After said solution was stirred for 5 minutes, was added with all of solution G1, whereby a silver halide emulsion was precipitated. The resulting supernatant was then removed while leaving 2,000 ml of the resulting precipitation, which was added with 10 L of water. After stirring, the silver halide emulsion was precipitated again. Subsequently, the resulting supernatant was removed while leaving 1,500 ml of the precipitate, which was further added with 10 L of water. After stirring, the silver halide emulsion was precipitated. After the resulting supernatant was removed while leaving 1,500 ml of the precipitate, solution H1 was added and the resulting mixture was heated to 60° C. and stirred for further 120 minutes. Finally, the pH was adjusted to 5.8 and water was added so as to make a total weight of 1,161 g per mol of silver, whereby photosensitive silver halide emulsion 1 was prepared.

Silver halide grains in silver halide emulsion 1 prepared in the above manner was monodispersed cubic silver iodobromide grains having an average equivalent spherical diameter of 0.060 μm, a variation coefficient of equivalent spherical diameter of 12%, and [100] plane ratio of 92%. The average equivalent spherical diameter and a coefficient of variation of equivalent spherical diameter were determined from an average of 1000 grains by use of an electronmicroscope. Further, [100] plane ratio of these grains was determined by Kubelka-Munk's theory.

Herein, the ratio of silver halide grains having a mean grain size of not less than 0.001 μm and not more than 0.050 μm, in silver halide emulsion 1, was 61 weight % of the total silver halide grains based on a silver amount.

[Preparation of Silver Halide Emulsions 2-4: Adsorption of Dispersant]

Polymer A solution of 20 g was added with water to make 60 g, which was stirred at 40° C. for 30 minutes. The resulting solution was added with silver halide emulsion 1 of 59.2 g being adjusted at 40° C. and stirred for further 30 minutes, whereby silver halide emulsion 2 was prepared. Silver halide emulsion 3 was prepared in a similar manner to preparation of silver halide emulsion 2, except that polymer B solution was used instead of polymer A solution. Further, silver halide emulsion 4 was prepared in a similar manner to preparation of silver halide emulsion 2, except that polymer C solution was used instead of polymer A solution.

[Preparation of Silver Halide MEK Emulsions 1-41]

Silver halide emulsions 1-4 each were sampled to make an equivalent mol of silver halide, being diluted two times with MEK, and the water content was removed by means of vacuum evaporation by use of a rotary evaporator. Whereby, silver halide MEK emulsions 1-4 were prepared. Water content was measured by a Karl Fischer's method, and dispersibility in MEK was evaluated by visual observation to see whether it is well dispersed or aggregated. The results are described in Table 2.

TABLE 2

| Silver halide MEK Emulsion | Dispersant polymer | Dispersibility Of AgX | Remarks |
|---|---|---|---|
| 1 | — | Aggregated | Comp. |
| 2 | A | Dispersed | Inv. |
| 3 | B | Dispersed | Inv. |
| 4 | C | Dispersed | Inv. |

Note:
AgX: Silver halide
Comp.: Comparative example
Inv.: This invention

<Preparation of Powder Organic Silver Salt A-1 Containing Silver Halide Grains>

Organic silver salt grains were prepared by utilizing unpurified behenic acid (a reagent on the market). This behenic acid was analyzed by a later-mentioned analytical method to determine the content of behenic acid to be 80 weight %. Since the rest included arachdinic acid and stearic acid, by utilizing reagents of arachidinic acid, stearic acid and palmitic acid, each organic acid reagent was mixed, so as to make 130.8 g of behenic acid, 67.7 g of arachidinic acid, 43.6 g of stearic acid and 2.3 g of palmitic acid, and charged in 4720 ml of pure water to be dissolved at 80° C. Subsequently, added to the resulting mixture were 540.2 ml of a 1.5 mol/L sodium hydroxide aqueous solution and 6.9 ml of concentrated sulfuric acid, and the resulting mixture was then cooled to 55° C., whereby a fatty acid sodium salt solution was prepared. While maintaining the temperature of said fatty acid sodium salt solution at 55° C. in the dark (hereinafter, this light-shielded state has been continued), 45.3 g of aforesaid silver halide emulsion 1 and 450 ml of pure water were added and stirred for 5 minutes. Subsequently, 702.6 ml of 1 mol/L silver nitrate solution were added over 2 minutes and the resulting mixture was stirred for 10 minutes, whereby organic silver salt grain dispersion A-1, containing silver halide grains, was prepared. Thereafter, the prepared organic silver salt grain dispersion A-1, containing silver halide grains, was transferred into a washing vessel, and after addition of deionized water and stirring, the resulting dispersion was allowed to stand so that the organic silver salt grain dispersion A-1, containing silver halide grains, was separated as the supernatant and water-soluble salts below the supernatant were removed. The supernatant organic silver salt grain dispersion was repeatedly washed with deionized water and drained until the electric conductivity of the drainage reached 2 μS/cm, and then dehydrated by centrifuge, whereby organic silver salt grains A-1, containing silver halide grains, of a cake form was obtained. The organic silver salt grains. A-1, containing silver halide grains, of a cake form, was dried by use of a fluid bed dryer (Mizet Dryer MDF-64 Type, manufactured by Dulton Corp.) until the water content reached 0.1% under a nitrogen gas environment and a controlled operation condition of a hot wind temperature of 65° C. at an inlet and 40° C. at an outlet, resulting in preparation of powder organic silver salt A-1 containing silver halide grains. The water content of powder organic silver salt A-1 containing silver halide grains was determined by use of an infrared water content analyzer. As a result of quantitative analysis of a behenic acid content in powder organic silver salt A-1 containing silver halide grains by means of the following analytical method, the behenic acid ratio contained in powder organic silver salt A-1 containing silver halide grains was 54 weight %. Herein, as a result of analysis of organic acid after mixing, a heavy metal content was 5 ppm and an iodine value was 1.5.

<Analytical Method of Organic Silver Salt>

The content of silver behenate was determined as follows. Organic silver salt of approximately 10 mg is weighed precisely and was charged in an egg-plant type flask of 200 ml. Methanol of 15 ml and hydrochloric acid of 3 ml. were added and the mixture is ultrasonic dispersed for 1 minute. The system is refluxed for 60 minutes with addition of zeolite manufactured by Teflon®. After cooling, 5 ml of methanol are added over the cooled product to wash out those adhered on a reflux condenser into an egg-plant type flask (twice). Prepared reaction solution is subjected to ethyl acetate extraction (ethyl acetate 100 ml, water 70 ml are added for liquid separation, twice). The resulting product is dried under reduced pressure for 30 minutes. Benzanthrone solution (an internal standard) of 1 ml is charged in a messflask of 10 ml. A sample dissolved in toluene is charged in the messflask and messed up by toluene. This is measured by GC to determine mol % from the peak area of each organic acid, whereby it is possible to know the composition of the total organic acid by determining weight %.

Successively, free organic acid, which has not been converted to organic silver salt, is determined. An organic acid sample of approximately 20 g is precisely weighed, to which 10 ml of methanol is added, and the resulting mixture is subjected to ultrasonic dispersion for 1 minute. The dispersion is filtered and the filtrate is dried to extract free organic acid. Thereafter, in a similar manner to the case of the total organic acid, it is possible to know the composition and ratio to the total organic acid, of free organic acid. The portion of the total organic acid minus free organic acid was designated as the composition of organic acid existing as organic silver salt.

[Powder Organic Silver Salt A-2 Without Silver Halide Grains]

Powder organic silver salt A-2 without silver halide grains was prepared in a similar manner to the preparation of powder organic silver salt A-1 containing silver halide grains described above, except that the same quantity of water was used instead of silver halide emulsion 1. The silver behenate ratio of this powder organic silver salt A-2 without silver halide grains was 55 weight %.

<Preparation of Photosensitive Emulsion Dispersion A-1>

Polyvinyl butyral. (Butvar B-79, produced by Monsanto Corp.) of 26.26 g as a dispersion binder was dissolved in 2000 g of methyl ethyl ketone, to which aforesaid powder organic silver salt A-1 containing silver halide grains was gradually added while stirring with Dissolver Dispermat CA-40M Type, manufactured by VMA-GETZMANN Co., and the resulting mixture was sufficiently mixed to prepare preliminary dispersion A-1.

By employing a pump, aforesaid preliminary dispersion A-1 was supplied into a media type homogenizer, Dispermat Type SL-C12EX (produced by VMA-Getzmann Co.), filled with 0.5 mm diameter zirconia beads (Torayceram, manufactured by Toray Industries Inc.) at an amount of 80% of the interior volume, so as to obtain a retention time in the mill of 1.5 minutes, and was dispersed at a circumferencial speed of the mill of 8 m/second, whereby photosensitive emulsion dispersion A-1 was prepared.

<Preparation of Photo-insensitive Emulsion Dispersion A-2>

Photo-insensitive emulsion dispersion A-2 was prepared in a similar manner to the preparation of aforesaid photosensitive emulsion dispersion A-1, except that powder organic silver salt A-2 without silver halide grains was used instead of powder organic silver salt A-1 containing silver halide grains.

<Preparation of Support>

On one side surface of polyethylene terephthalate film having a thickness of 175 μm and being blue colored at a density of 0.170, after having been subjected to corona discharge treatment at 0.5 kV·A·min/m$^2$, coated was under-coat layer "a" by use of following under-coat coating composition A so as to make a dry layer thickness of 0.2 μm. Further, on the other surface, similarly after having been subjected to corona discharge treatment at 0.5 kV·A·min/m$^2$, coated was under-coat layer "b" by use of following under-coat coating composition B so as to make a dry layer thickness of 0.1 μm. Thereafter, the coated film was subjected to a thermal treatment at 130° C. for 15 minutes in a thermal processing type oven equipped with a film transport apparatus constituted of a plural number of roll groups.

(Under-coat Coating composition A)

A copolymer latex solution (solid content of 30%) of butyl acrylate/t-butyl acrylate/styrene/2-hydroxyethyl acrylate (30/20/25/25%) of 270 g, 0.6 g of surfactant (UL-1) and 0.5 g of methyl cellulose were mixed. Further, the resulting mixture was added with dispersion, which is comprised of 1.3 g of silica particles added with 100 g of water and having been dispersed by use of an ultrasonic homogenizer (Ultrasonic Generator, frequency 25 kHz, 600 W, produced by ALEX Corporation) for 30 minutes, and the mixture was finally made to 1000 ml with water, which was utilized as under-coat coating composition A.

(Under-coat Coating composition B)

The following colloidal tin oxide dispersion of 37.5 g, 3.7 g of a copolymer latex solution (solid content of 30%) of butyl acrylate/t-butyl acrylate/styrene/2-hydroxyethyl acrylate (20/30/25/25%), 14.8 g of a copolymer latex solution (solid content of 30%) of butyl acrylate/styrene/glycidyl methacrylate (40/20/40%) and 0.1 g of surfactant (UL-1) were mixed and the mixture was made to 1000 ml with water, which was utilized as under-coat coating composition B.

<Preparation of Colloidal Tin Oxide Dispersion>

Tin (IV) chloride hydrate of 65 g was uniformly dissolved in 2000 ml of water/ethanol mixed solution to prepare a homogeneous solution. Subsequently, this was boiled to obtain a co-precipitate. The formed precipitate was taken out by decantation, and was washed with distilled water a few times. After confirming there was no reaction of a chlorine ion by titrating silver nitrate into the distilled water having been used to wash the precipitate, distilled water was added to the washed precipitate to make the volume to 2000 ml. Further, 40 ml of 30% ammonia water were added to the resulting mixture, and the aqueous solution was heated and concentrated until making a volume of 470 ml, whereby a colloidal tin oxide dispersion was prepared.

UL-1

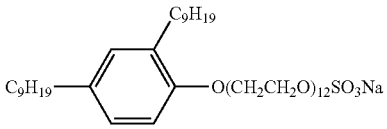

<Preparation of Sample 101>

According to the following procedure, sample 101 as a thermally developable photosensitive material was prepared.

[Back Surface Side Coating]

Added and dissolved were 84.2 g of cellulose acetate butyrate (CAB 381-20, produced by Eastman Chemical Corp.) and 4.5 g of polyester resin (Vitel PE2200B, produced by Bostic Co.) in 830 g of methyl ethyl ketone while stirring. Subsequently, the dissolved solution was added with 0.30 g of infrared dye 1, 4.5 g of flurorine-type surfactant-1 and 1.5 g of fluorine-type surfactant (Ftop EF-105, produced by Jemco Corp.) and sufficiently stirred until dissolution. Finally, 75 g of silica particles (Silicia 450, produced by Fuji Silicia Co., Ltd.), which are dispersed in methyl ethyl ketone at a concentration of 1% by use of a dissolver type homogenizer, were added and the resulting mixture was stirred, whereby a back surface coating composition was prepared.

Fluorine-type surfactant-1: $C_9F_{17}O(CH_2CH_2O)_{22}C_9F_{17}$

Subsequently, the prepared back surface coating composition was coated, on the surface of the aforesaid support on which under-coat layer "b" had been coated and dried by use of an extrusion coater so as to make a dry layer thickness of 3.5 μm. The coated film was dried for 5 minutes by utilizing drying wind having a drying temperature of 100° C. and a dew point of 10° C.

Infrared Dye 1

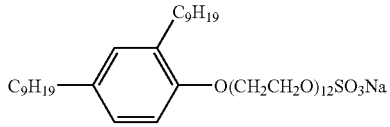

[Coating of Photosensitive Layer Side]

(Preparation of Each Additive Solution)

<Preparation of Stabilizer Solution>

Stabilizer-1 of 1.0 g and 0.31 g of potassium acetate were dissolved in 4.97 g of methanol, whereby a stabilizer solution was prepared.

<Preparation of Infrared Sensitizing Dye Solution A>

Infrared Sensitizing Dye-1 of 19.2 mg, 1.488 g of 2-chlorobenzoic acid, 2.779 g of Stabilizer-2 and 365 mg of 5-methyl-2-mercaptobenzoimidazole were dissolved in 31.3 ml of methyl ethyl ketone in the dark, whereby infrared Sensitizing Dye Solution A was prepared.

<Preparation of Additive Solution a>

1,1-bis(2-hydroxy-3,5-dimethylphenyl)-3,5,5-trimethylhexane of 27.98 g as a developer, 1.54 g of 4-methyl phthalic acid 0.48 g of aforesaid Infrared Dye 1 were dissolved in 110 g of methyl ethyl ketone, whereby additive solution "a" was prepared.

(Preparation of Additive Solution b)

Antifoggan-2 of 3.56 g and 3.43 g of phthalazine were dissolved in 40.9 g of methyl ethyl ketone, whereby additive solution "b" was prepared.

(Preparation of Photosensitive Layer Coating Composition 1)

Aforesaid Photosensitive Emulsion Dispersion A-1 of 50 g and 15.11 g of methyl ethyl ketone were kept at 18° C. while stirring under an inert gas environment (97% nitrogen gas), and were added with 390 μl of Anti-foggant-1 (a 10% methanol solution) and stirred for 1 hour. Further, the resulting mixture was added with 494 μl of calcium bromide (a 10%. methanol solution) and stirred for 20 minutes. Subsequently, after 167 μl of a stabilizer solution were added and stirred, 1.32 g of aforesaid Infrared Sensitizing Dye Solution A were added and stirred for 1 hour. Subsequently, the temperature was lowered to 13° C. and the resulting mixture was stirred for further 30 minutes. After the mixture was added with 13.31 g of polyvinyl butyral (Butvar B-79, produced by Monsanto Corp.) and was stirred for 30 minutes while keeping the temperature at 13° C., 1.084 g of tetrachlorophthalic acid (a 9.4 weight % methyl ethyl ketone solution) were added and stirred for 15 minutes. Into the resulting mixture, 12.43 g of additive solution "a", 1.6 ml of Desmodur N3300 (aliphatic isocyanate, produced by Mobey Co., a 10% methyl ethyl ketone solution) and 4.27 g of additive solution "b" were successively added and stirred, whereby Photosensitive Layer Coating Composition 1 was prepared.

Stabilizer-1

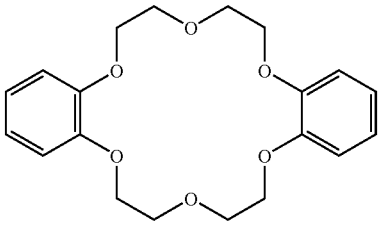

-continued

Stabilizer-2

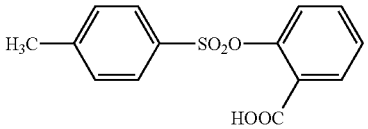

Infrared Sensitizing Dye-1

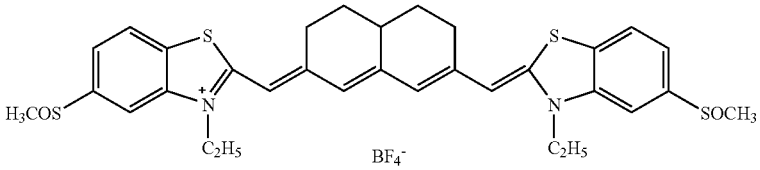

Anti-foggant-2

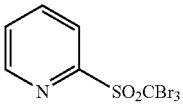

Anti-foggant-1

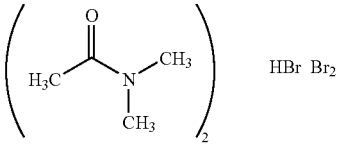

(Preparation of Photosensitive Layer Coating compositions 2-4)

Aforesaid silver halide MEK emulsion 2 of 7.2 g was kept at 18° C. while stirring under an inert gas environment (97% nitrogen gas), and were added with 390 μl of anti-foggant-1 (a 10% methanol solution) and stirred for 1 hour. Further, the resulting mixture was added with 494 μl of calcium bromide (a 10% methanol solution) and stirred for 20 minutes. Subsequently, after 167 μl of a stabilizer solution were added and stirred, 1.32 g of aforesaid infrared sensitizing dye solution A were added and stirred for 1 hour. Subsequently, the temperature was lowered to 13° C. and the resulting mixture was stirred for further 30 minutes, whereby spectrally sensitized silver halide MEK emulsion 2 was prepared. In the separate vessel under an inert gas environment (97% nitrogen gas), 50 g of aforesaid photo-insensitive emulsion dispersion A-2 and 15.11 g of methyl ethyl ketone were kept at 13° C. while stirring, and after the mixture was added with 13.31 g of polyvinyl butyral (Butvar B-79) and was stirred for 30 minutes, 1.084 g of tetrachlorophthalic acid (a 9.4 weight % methyl ethyl ketone solution) were added and stirred for 15 minutes. The resulting mixture, while continuously stirring, successively added with 12.4 g of additive solution "a", 1.6 ml of Desmodur N3300 (a 10% methyl ethyl ketone solution of aliphatic isocyanate, produced by Mobey Co.,), 4.27 g of additive solution "b" and aforesaid spectrally sensitized silver halide MEK emulsion 2 and stirred, whereby photosensitive layer coating composition 2 was prepared. Further, photosensitive layer coating compositions 3 and 4 were prepared in a similar manner except that silver halide MEK emulsion 2 was replaced by aforesaid silver halide MEK emulsions 3 and 4.

(Preparation of Surface Protective Layer Coating Composition)

In 865 g of methyl ethyl ketone while stirring, 96 g of cellulose acetate butyrate (CAB 171-15: described above), 4.5 g of polymethyl methacrylate (Palaroid A-21, produced by Rhom & Haas Co.), 1.0 g of benzotriazole and 1.0 g of a fluorine-type surfactant (Ftop EF-105, produced by Jemco Corp.) were added and dissolved. Successively, the resulting solution was added with 30 g of the following matting agent dispersion and stirred, whereby a surface protective layer coating composition was prepared.

<Preparation of Matting Agent Dispersion>

Cellulose acetate butyrate (CAB 171-15, produced by Eastman Chemical Corp.) of 7.5 g was dissolved in 42.5 g of MEK, to which 5 g of silica particles (Sylicia 320, produced by Fuji Silicia Co., Ltd.) were added, and the resulting mixture was dispersed by a dissolver type homogenizer at 8000 rpm for 30 minutes, resulting in preparation of a matting agent dispersion.

(Coating)

Photosensitive layer coating composition 1 and the surface protective layer coating composition, prepared above, were simultaneously coated by an extrusion type coater well known in the art. The coating was performed so as to make the coating silver amount of 1.7 g/m$^2$ and a dry layer thickness of the surface protective layer of 2.5 μm. Thereafter, the coated product was dried by use of drying wind having a drying temperature of 75° C. and a dew point of 10° C. for 10 minutes, whereby sample 101 was prepared.

<Preparation of Samples 102-104>

Samples 102-104 were prepared in a similar manner to above-described sample 101, except that photosensitive layer coating compositions 2-4 were utilized instead of photosensitive layer coating composition 1.

<Evaluation of Thermally Developable Photosensitive Material>

With respect to samples 101-104, prepared above, various evaluations were performed according to the following methods.

[Exposure and Development Process]

Each sample prepared above was subjected to exposure from the photosensitive layer coated surface side by means of laser scanning by use of an exposing apparatus employing a semiconductor laser, which had been made into a lateral multi-mode at 800-820 nm by high frequency accumulation, as a light source through an optical wedge. At this time, an image was formed setting the angle between the exposure plane of a sample and the exposure laser light to 75°. In this case, compared to the case of said angle being set to 90°, obtained was an image exhibiting minimum unevenness and such as surprisingly superior sharpness.

Thereafter, by use of an automatic processor provided with a heating drum and a cooling zone, carried out was development, bringing the protective layer in contact with the drum surface. In this case, exposure and development were carried out in a room being rehumidified at 23° C. and 50% RH.

[Measurement of Sensitivity, Fog Density and Maximum Density]

Density of the obtained silver image comprising a wedge gradation was measured by a densitometer, and formed was a characteristic curve constituted of silver image density (D) as ordinate and logarithm (log E) of exposure (E) as abscissa.

In this characteristic curve, determined was the sensitivity, being defined as a reciprocal of the ratio of an exposure quantity necessary to provide a density higher by 1.0 than the minimum density (fog density). Further, the minimum density (fog density) and the maximum density were determined. Herein, the sensitivity and the maximum density are shown in Table 3, as relative values when the sensitivity and the maximum density of sample 101 are set to 100.

[Dispersibility Evaluation in Coated Layer]

With respect to each coated sample, according to the aforesaid method, visually evaluated was dispersibility of photosensitive silver halide grains having a grain size, which is measured from an exposure direction of a photosensitive material, of not less than 0.005 μm and not more than 0.1 μm, based on the following image of a transmission type electron-microscope (hereinafter, referred to as a TEM).

That is, an ultra-thin slice having a thickness of 0.1-0.2 μm was prepared by use of a diamond knife, and this ultra-thin slice was held on a copper mesh to be transferred on a carbon film, which had been made hydrophilic by grow discharge, followed by being observed through a TEM in a light range of vision and at a magnification of 5,000-40,000 and the images were quickly recorded on a CCD camera. A very thin colodion organic film was utilized as a carbon film, and an acceleration voltage of a TEM was set to 150 kV. The recorded TEM images were visually observed to evaluate dispersibilty, and the results are shown in Table 3.

[Evaluation of Humidity Dependence]

With respect to samples 101-104, after having been rehumidified under an environment of 23° C. and 80% RH for 3 days, exposure and development were performed in a similar manner to those described above. Fog density was measured at that time as evaluation of humidity dependence, which are shown in Table 3.

It is clear from the results of Table 3 that a thermally developable photosensitive material of this invention can provide an output image exhibiting lower minimum density with the same or higher sensitivity, and maximum density, compared to a comparative example, as well as small humidity dependence, which is suitable for a diagnostic image.

Example 2

<Synthesis of Polymers A(2), B(2) and C(2) for Dispersion of Silver Halide Grains>

A 4-necked separable flask of 0.5 liter equipped with a titration device, a thermometer, a nitrogen gas introducing tube, a stirrer and a reflux condenser was charged with 50 g of methyl ethyl ketone, the composition ratio described in Table 1(2) of monomers (g) other than NIPAM having and 0.12 g of lauryl peroxide and was heated at a temperature described in Table 1 (2). Further, a solution, in which NIPAM monomer (g) described in Table 1(2) was dissolved in 43 g of methyl ethyl ketone, was titrated over 2 hours into the flask. Thereafter, after the solution was heated over 1 hour to be a reflux state, absolution, in which 0.17 g of lauryl peroxide were dissolved in 33 g of methyl ethyl ketone, was titrated over 2 hours, followed by being reacted at the same temperature for 3 hours. Subsequently, a solution in which 0.33 g of methyl hydroquinone were dissolved in 107 g of methyl ethyl ketone was added and the solution was cooled, resulting in preparation of polymer solutions A(2), B(2) and C(2) having a polymer concentration of 30 weight %. Molecular weight was determined as a polystyrene conversion weight average molecular weight by means of GPC.

Details of each monomer described by abbreviation are as follows.

PME-400: Blemmer PME-400, produced by NOF Corp. (methacrylate provided with $-(EO)_m—CH_3$ (m is approximately 9) (EO represents an ethylene oxy group))

PSE-400: Blemmer PSE-400, produced by NOF Corp. (methacrylate provided with $-(EO)_m—C_{18}H_{37}$ (m is approximately 9) (EO represents an ethylene oxy group))

NIPAM: N-isopropyl acrylamide

DMMA: diacetone acrylamide (produced by Kyowa Hakko Kogyo Co., Ltd.)

TABLE 3

| Sample | Organic silver salt dispersion | Silver halide MEK emulsion | Minimum density | Minimum density after humidity conditioning | Sensitivity | Maximum density | MEK dispersibility | Remarks |
|---|---|---|---|---|---|---|---|---|
| 101 | Photosensitive A-1 | — | 0.195 | 0.225 | 100 | 3.2 | Aggregated | Comp. |
| 102 | Photo-insensitive A-2 | 2 | 0.170 | 0.170 | 150 | 3.9 | Dispersed | Inv. |
| 103 | Photo-insensitive A-2 | 3 | 0.165 | 0.175 | 170 | 4.2 | Dispersed | Inv. |
| 104 | Photo-insensitive A-2 | 4 | 0.175 | 0.185 | 150 | 3.8 | Dispersed | Inv. |

TABLE 1(2)

| Polymer No. | Monomer component (g) DAAM | PSE-400 | PME-400 | NIPAM | Charging temperature (° C.) | Mean molecular weight ($\times 10^4$) |
|---|---|---|---|---|---|---|
| A(2) | 45 | 20 | 20 | 15 | 80 | 5-7 |
| B(2) | 45 | 20 | 20 | 15 | 60 | 8-10 |
| C(2) | 55 | 20 | 20 | 5 | 60 | 8-10 |

<Preparation of Silver Halide Emulsion>

<Preparation of Silver Halide Emulsion 1(2)>

| | |
|---|---|
| (Solution A1) | |
| Phenyl carbamoyl gelatin | 88.3 g |
| Compound A (*1) (10% methanol aqueous solution) | 10 ml |
| Potassium bromide | 0.32 g |
| Water to make | 5429 ml |
| (Solution B1) | |
| 0.67 mol/L silver nitrate aqueous solution | 2635 ml |
| (Solution C1) | |
| Potassium bromide | 51.55 g |
| Potassium iodide | 1.47 g |
| Water to make | 660 ml |
| (Solution D1) | |
| Potassium bromide | 154.9 g |
| Potassium iodide | 4.41 g |
| $K_3IrCl_6$ ($4 \times 10^{-5}$ mol/Ag equivalent) | 50.0 ml |
| Water to make | 1982 ml |
| (Solution E1) | |
| 0.4 mol/L potassium bromide aqueous solution | An amount to controlling later-mentioned silver potential |
| (Solution F1) | |
| Potassium hydroxide | 0.71 g |
| Water to make | 20 ml |
| (Solution G1) | |
| 56% acetic acid aqueous solution | 18.0 ml |
| (Solution H1) | |
| Sodium carbonate unhydride | 1.72 g |
| Water to make | 151 ml |

(*1) Compound A: $HO(CH_2CH_2O)_n[CH(CH_3)CH_2O]_{17}(CH_2CH_2O)_mH$ (m + n = 5-7)

Employing a mixing stirrer described in Examined Japanese Patent Publication No. 58-58288, added to solution A1 were ¼ solution B1 and total solution C1 over 4 minutes 45 seconds utilizing a double-jet method, while adjusting the temperature to 45° C. and the pAg to 8.09, whereby nuclei were formed. After 1 minute all of solution F1 was added. Meanwhile the pAg was appropriately adjusted by employing solution E1. After 6 minutes, added to the resulting mixture were ¾ solution B1 and all of solution D1 over 14 minutes 15 seconds employing a double-jet method, while adjusting the pAg to 8.09. Said solution, after having been stirred for 5 minutes, was added with all of solution G1, whereby a silver halide emulsion was precipitated. The resulting supernatant was then removed while leaving 2,000 ml, of the resulting precipitation, which was added with 10 L of water. After stirring, the silver halide emulsion was precipitated again. Subsequently, the resulting supernatant was removed while leaving 1,500 ml of the precipitate, which further was added with 10 L of water. After stirring, the silver halide emulsion was precipitated. After the resulting supernatant was removed while leaving 1,500 ml of the precipitate, solution H1 was added and the resulting mixture was heated to 60° C. and stirred for further 120 minutes. Finally, the pH was adjusted to 5.8 and water was added so as to make a total weight of 1,161 g per mol of silver, whereby photosensitive silver halide emulsion 1(2) was prepared.

Silver halide grains in silver halide emulsion 1(2) prepared in the above manner was monodispersed cubic silver iodobromide grains having an average equivalent spherical diameter of 0.060 μm, a variation coefficient of equivalent spherical diameter of 12%, and [100] plane ratio of 92%. The average equivalent spherical diameter and coefficient of variation of equivalent spherical diameter were determined from an average of 1000 grains by use of an electronmicroscope. Further, [100] plane ratio of this grain was determined by Kubelka-Munk's method Herein, the ratio of silver halide grains having a mean grain size of not less than 0.001 μm and not more than 0.050 μm, in silver halide emulsion 1(2), was 61 weight % of the total silver halide grains based on a silver amount.

[Preparation of Polymer Dispersed Silver Halide Emulsions 2(2)-4(2) (Silver Halide Grain Dispersion in Methyl Ethyl Ketone)]

Polymer A(2) solution of 33 g was made up to 121 g with methanol, and was stirred at 45° C. for 30 minutes. Therein silver halide emulsion 1 (59.2 g) adjusted at 45° C. was titrated over 20 minutes, and the mixture was stirred for further 30 minutes. After the mixture was cooled to 32° C. in 30 minutes, 600 g of methyl ethyl ketone was titrated over 30 minutes to obtain silver halide emulsion 2(2).

Silver halide emulsion 3(2) was prepared in a similar manner to the preparation of the above silver halide emulsion 2(2) except that polymer B(2) solution was utilized in stead of polymer A(2) solution.

Silver halide emulsion 4(2) was prepared in a similar manner to the preparation of the above silver halide emulsion 2(2) except that polymer C(2) solution was utilized in stead of polymer A(2) solution.

<Preparation of Powder Organic Silver Salt>

[Preparation of Powder Organic Silver Salt A(2) Containing Silver Halide Grain]

Behenic acid of 130.8 g, 67.7 g of arachidinic acid, 43.6 g of stearic acid and 2.3 g of palmitic acid were dissolved in 4720 ml of pure water at 80° C. Subsequently, the resulting solution was added with 540.2 ml of a 1.5 mol/L sodium hydroxide aqueous solution and 6.9 ml of concentrated sulfuric acid, followed by being cooled to 55° C., whereby a fatty acid potassium salt solution was prepared. While maintaining the temperature of said fatty acid potassium salt solution at 55° C., 45.3 g of aforesaid silver halide emulsion 1 and 450 ml of pure water were added and stirred for 5 minutes.

Next, 702.6 ml of 1 mol/L silver nitrate solution were added over 2 minutes and the resulting mixture was stirred for 10 minutes, whereby an organic silver salt dispersion was prepared. Thereafter, the prepared organic silver salt dispersion was transferred into a washing vessel, and after adding deionized water and stirring, the resulting dispersion was allowed to stand so that the organic silver salt dispersion was separated as the supernatant and water-soluble salts below the supernatant were removed. The supernatant organic silver salt was repeatedly washed with deionized water and drained until the electric conductivity of the drainage reached 2 μS/cm, and then dehydrated by centrifuge, whereby organic silver salt of a cake form was obtained. The organic silver of a cake form was dried by use of an air flow type flush jet dryer (produced by Seishin Enterprise Co., Ltd.) until the water content reached 0.1% under a nitrogen gas environment and a controlled operation condition of an inlet hot wind temperature (65° C. at inlet and 40° C. at outlet), resulting in preparation of powder organic silver salt A(2). Herein, the water content of an organic silver salt composition was measured by use of an infrared water content analyzer.

Organic silver salt grains were prepared by utilizing unpurified behenic acid (a reagent on the market). This behenic acid was analyzed by an analytical method well known in the art to determine the content of behenic acid to be 80 weight %. Since the rest included arachdinic acid and atearic acid, by utilizing reagents of arachidinic acid, stearic acid and palmitic acid, each organic acid reagent was mixed, so as to make 130.8 g of behenic acid, 67.7 g of arachidinic acid, 43.6 g of stearic acid and 2.3 g of palmitic acid, and charged in 4720 ml of pure water to be dissolved at 80° C.

Subsequently, added to the resulting mixture were 540.2 ml of a 1.5 mol/L sodium hydroxide aqueous solution and 6.9 ml of concentrated sulfuric acid, and the resulting mixture was then cooled to 55° C., whereby a fatty acid sodium salt solution was prepared. While maintaining the temperature of the fatty acid sodium salt solution at 55° C. in the dark (hereinafter, this light-shielded state has been continued), the solution was added with 45.3 g of aforesaid silver halide emulsion 1 and 450 ml of pure water and stirred for 5 minutes. Subsequently, 702.6 ml of 1 mol/L silver nitrate solution were added over 2 minutes and the resulting mixture was stirred for 10 minutes, whereby organic silver salt grain dispersion A-1 (2), containing silver halide grains, was prepared.

Thereafter, the prepared organic silver salt grain dispersion A-1(2), containing silver halide grains, was transferred into a washing vessel, and after adding deionized water and stirring, the resulting dispersion was allowed to stand so that the organic silver salt dispersion A(2), containing silver halide grains, was separated as the supernatant and water-soluble salts below the supernatant were removed. The supernatant organic silver salt was repeatedly washed with deionized water and drained until the electric conductivity of the drainage reached 2 μS/cm, and then dehydrated by centrifuge, whereby organic silver salt grains A(2), containing silver halide grains, of a cake form was obtained.

The organic silver salt grains A(2), containing silver halide grains, of a cake form was dried by use of a fluid bed dryer (Mizet Dryer MDF-64 Type, produced by Dulton Co., Ltd.) until the water content reached 0.1% under a nitrogen gas environment and a controlled operation condition of an inlet hot wind temperature, resulting in preparation of powder organic silver salt A containing silver halide grains.

Herein, the water content of powder organic silver salt A(2), containing silver halide grains, was measured by use of an infrared water content analyzer. As a result of quantitative analysis of a behenic acid content in powder organic silver salt A(2), containing silver halide grains, by means of the following analytical method, the behenic acid ratio contained in powder organic silver salt A(2), containing silver halide grains, was 43 mol %. Herein, analysis of organic acid after mixing determined a heavy metal content to be 5 ppm and an iodine value to be 1.5.

<Analytical Method of Organic Silver Salt>

The content of silver behenate was determined as follows organic silver salt of approximately 10 mg is weighed precisely and was charged in an egg-plant type flask of 200 ml. Methanol of 15 ml and hydrochloric acid of 3 ml were added and the mixture is ultrasonic dispersed for 1 minute. The system is refluxed for 60 minutes with addition of zeolite produced by Teflon®. After cooling, 5 ml of methanol are added over the cooled product to wash out those adhered on a reflux condenser into an egg-plant type flask (twice). Prepared reaction solution is subjected to ethyl acetate extraction (ethyl acetate 100 ml, water 70 ml are added for liquid separation, twice) The resulting product is dried under reduced pressure for 30 minutes. Benzanthrone solution (an internal standard) of 1 ml is charged in a messflask of 10 ml. A sample dissolved in toluene is charged in a messflask and messed up by toluene. This is measured by GC to determine mol % from the peak area of each organic acid, whereby it is possible to know the composition of the total organic acid by determining weight %.

Successively, free organic acid, which has not been converted to organic silver salt, is determined. An organic acid sample of approximately 20 g is precisely weighed, to which 10 ml of methanol is added, and the resulting mixture is subjected to ultrasonic dispersion for 1 minute. The dispersion is filtered and the filtrate is dried to extract free organic acid. Thereafter, in a similar manner to the case of the total organic acid, it is possible to know the composition and ratio to the total organic acid, of free organic acid. The portion of the total organic acid minus free organic acid was designated as the composition of organic acid existing as organic silver salt.

[Powder Organic Silver Salt B(2) without Silver Halide Grains]

Powder organic silver salt B(2) without silver halide grains was prepared in a similar manner to the preparation of powder organic silver salt A(2), containing silver halide grains, described above, except that the same quantity of water was used instead of silver halide emulsion 1(2). The silver behenate ratio of this powder organic silver salt B(2) without silver halide grains was 43 mol %.

[Powder Organic Silver Salt C(2) Without Silver Halide Grains]

In a tank, after 252 ml of a 5 mol/L KOH aqueous solution were added over 5 minutes into 450 g of aliphatic carboxylic acid and 7,695 g of pure water while stirring at 85° C., the solution was reacted for 60 minutes to prepare a potassium aliphatic carboxylate aqueous solution. Finally, additional water was added to make the total volume to 8550 g. Further, in a separate tank, 4280 ml of a 5% silver nitrate aqueous solution were prepared and kept at 10° C. The aforesaid potassium aliphatic carboxylate aqueous solution and silver nitrate aqueous solution each were transferred as the whole to the two-solution mixing portion at a constant rate over 10 minutes and were stocked in a storing tank. Herein, the tank was kept at 30° C. Thereafter, the solid portion was filtered out by suction filtration, and was washed at 25° C. until the conductivity of the filtrate water became 30 μS/cm. The obtained dehydrated cake was dried to prepare dried powder organic silver salt C(2) comprised of silver aliphatic carboxylate grains. The obtained silver aliphatic carboxylate grains was provided with an equivalent spherical mean grain size of 0.36 μm, a standard deviation of 0.23 and a silver behenate ratio of 85 mol %.

<Preparation of Organic Silver Salt Dispersion>

<Preparation of Organic Silver Salt Dispersion A(2)>

Polyvinyl butyral of 49 g was dissolved in 1300 g of methyl ethyl ketone, subsequently 500 g of the above powder organic silver salt A(2) were gradually added therein, while stirring by use of a dissolver DISPERMAT CA-40M Type, produced by VMA-GETZMANN Co., and the resulting mixture was sufficiently mixed to prepare a pre-dispersion. By employing a pump, this preliminary dispersion was supplied into a media type homogenizer, Dispermat Type SL-C12EX (produced by VMA-Getzmann Co.), filled with 0.5 mm diameter zirconia beads (Torayceram, produced by Toray Industries Inc.) at an amount of 80% of the interior volume, so as to obtain a retention time in the mill of 1.2 minutes, and was dispersed at a circumferencial speed of the mill of 9 m/second, whereby organic silver salt dispersion A(2) was prepared. The solid concentration of prepared organic silver salt dispersion A(2) was approximately 27%.

<Preparation of Organic Silver Salt Dispersion B(2)>

Organic silver salt dispersion B(2) was prepared in a similar manner to the preparation of aforesaid organic silver salt dispersion A(2), except that powder organic silver salt B without silver halide grains was used instead of powder organic silver salt A(2) containing silver halide grains.

<Preparation of Organic Silver Salt Dispersion C(2)>

Organic silver salt dispersion C(2) was prepared in a similar manner to the preparation of aforesaid organic silver salt dispersion A(2), except that powder organic silver salt C(2) without silver halide grains was used instead of powder organic silver salt A(2) containing silver halide grains.

<Preparation of Silver Salt Photothermographic Dry Imaging Material>

[Preparation of Under-coated Support]

The both surface of biaxially stretched polyethylene terephthalate film having a blue dye density of 0.135 were subjected to a corona discharge treatment under a condition of 10 W/m$^2$-min, and one side of the surfaces was coated with the following back surface side lower under-coat coating composition so as to make a dry layer thickness of 0.06 μm followed by being dried at 140° C., subsequently the following back surface side upper under-coat coating composition so as to make a dry layer thickness of 0.2 μm followed by being dried at 140° C. These were thermal processed at 140° C. for 2 minutes to prepare an under-coated sample.

(Back Surface Side Lower Under-coat Layer Coating Composition)

| | |
|---|---|
| Styrene/glycidyl methacrylate/butyl acrylate (20/20/40) copolymer latex (solid content of 30%) | 16.0 g |
| Styrene/butyl acrylate/hydroxymethylmethacrylate (25/45/30) copolymer latex (solid content of 30%) | 4.0 g |
| $SnO_2$ sol (solid content of 10%, synthesized by a method described in JP-A 10-059720) | 91.0 g |
| Surfactant A | 0.5 g |

The above composition was added with distilled water to make 1000 ml, which is utilized as a coating composition.

Surfactant A

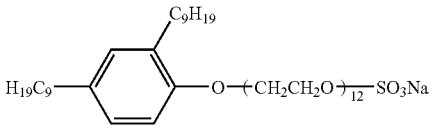

(Back Surface Side Upper Under-coat Layer Coating Composition)

| | |
|---|---|
| Modified water-based polyester A (solid content of 18%) | 215.0 g |
| Surfactant A | 0.4 g |
| True sphere-form silica matting agent (Seahostar KE-P50 (produced by Nippon Shokubai Co., Ltd.)) | 0.3 g |

The above composition was added with distilled water to make 1000 ml, which is utilized as a coating composition.

<Synthesis of Modified Water-based Polyester A>

Into a polymerization vessel, 35.4 parts of dimethyl terephthalate, 33.6 parts of dimethyl isophthalate, 17.92 g of sodium 5-sulfo-isopphthalate, 62 parts of ethylene glycol, 0.065 parts of calcium acetate monohydrate and 0.022 parts of manganese acetate tetrahydrate were charged, and ester exchange reaction was performed while evaporating methanol at 170-220° C. under nitrogen flow, subsequently, 0.04 weight parts of trimethyl phosphate; 0.04 weight parts of antimony tribxide and 6.8 parts of 1,4-cyclohexane dicarboxylic acid as polycondensation catalysts; were added to the system and approximately theoretical amount of water was evaporated at a reaction temperature of 220-235° C. to perform esterification. Thereafter, the interior of the reaction system was evacuated and heated for 1 hour to perform polycondensation for approximately 1 hour at not more than 280° C. and 133 Pa, whereby a precursor of modified water-based polyester A was prepared. The intrinsic viscosity of the precursor was 0.33.

In a three-necked flask equipped with a stirring fan, a reflux condenser and a thermometer, 850 ml of pure water was charged and 150 g of the aforesaid precursor were gradually added while rotating the stirring fan. After the resulting mixture was stirred for 30 minutes as it was, it was heated so as to make the internal temperature of 98° C. over 1.5 hours and was heating dissolved at this temperature for 3 hours. Then the system was cooled to room temperature over 1 hour, being kept standing for one night, thereby a precursor solution having a solid concentration of 15 weight % was prepared.

In a four-necked 3 L flask equipped with a stirring fan, a reflux condenser, a temperature and a titration funnel, 1900 ml of the above precursor solution were charged and the inside temperature was heated to 80° C. while rotating the stirring fan. In this solution, 6.52 ml of a 24% aqueous solution of ammonium persulfate were added, and a monomer mixed solution (28.5 g of glycidyl methacrylate, 21.4 g of ethyl acrylate and 21.4 g methyl methacrylate) was titrated over 30 minutes, followed by continuation of reaction for 3 hours. Thereafter, the solution was cooled to not higher than 30° C. and was cooled, whereby a solution of modified polyester A having a solid content of 18% was prepared.

(Photosensitive Layer Side Lower Under-coat Layer Coating Composition)

| | |
|---|---|
| Styrene/acetoacetoxyethyl methacrylate/glycidyl methacrylate/n-butyl acrylate (40/40/20/0.5) copolymer latex (solid content of 30%) | 70 g |
| Surfactant A | 0.3 g |

The above composition was added with distilled water to make 1000 ml, which is utilized as a coating composition.

(Photosensitive Layer Side Upper Under-coat Layer Coating composition)

| | |
|---|---|
| Modified water-based polyester B (solid content of 18%) | 80.0 g |
| Surfactant A | 0.4 g |
| True sphere-form silica matting agent (Seahostar KE-P50 (produced by Nippon Shokubai Co., Ltd.)) | 0.3 g |

The above composition was added with distilled water to make 1000 ml, which is utilized as a coating composition having a solid content of 0.5%.

<Synthesis of Modified Water-based Polyester B>

A solution of modified water-based polyester B was prepared in a similar manner to modified water-based polyester A, except that 1800 ml of precursor solution, and the monomer mixed solution comprising 31 g of styrene, 31 g of acetoacetoxyethyl methacrylate, 61 g of glycidyl methacrylate and 7.6 g of n-butyl acrylate were utilized.

<Preparation of Samples 101(2)-106(2)>

Samples 101(2)-106(2), which are silver salt photothermographic dry imaging materials, were prepared according to the following procedure.

| [Preparation of Surface Protective Layer Coating Composition] | |
|---|---|
| Methyl ethyl ketone | 1,056 g |
| Cellulose acetate propionate (CAP 141-20, produced by Eastman Chemical Corp.) | 148 g |
| Polymethyl methacrylate (Palaroid A21, produced by Rohm & Haas Corp.) | 6.0 g |
| Matting agent (silica having a dispersibility of 10% and a mean particle size of 4 μm, solid content of 1.7%) | 170 g |
| $CH_2{=}CHSO_2CH_2CH(OH)CH_2SO_2CH{=}CH_2$ | 3.6 g |
| Benzoimidazole | 2.0 g |
| $C_9F_{17}O(CH_2CH_2O)_{23}C_9F_{17}$ | 5.4 g |
| $LiO_3S{-}CF_2CF_2CF_2{-}SO_3Li$ | 0.12 g |
| [Preparation of Back Layer Coating composition] | |
| Methyl ethyl ketone | 1350 g |
| Cellulose acetate propionate (CAP 141-20, produced by Eastman Chemical Corp.) | 121 g |
| Dye-A | 0.23 g |
| Dye-B | 0.62 g |
| Fluorine type acryl copolymer (Optflon FM450, produced by Daikin Industry Co., Ltd.) | 1.21 g |
| Amorphous saturated copolymer ester (Optflon FM450, produced by Toyobo Co., Ltd.) | 18.1 g |
| Matting agent dispersion | confer the following |
| $C_9F_{17}O(CH_2CH_2O)_{23}C_9F_{17}$ | 5.21 g |
| $LiO_3S{-}CF_2CF_2CF_2{-}SO_3Li$ | 0.81 g |

Dye-A

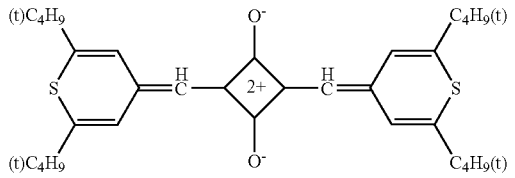

Dye-B

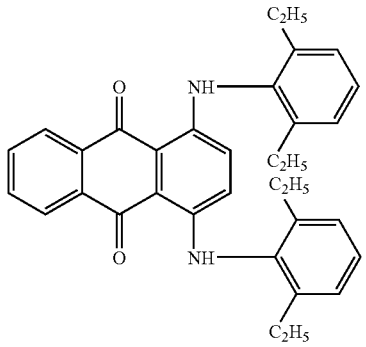

<Matting Agent Dispersion>

An organic solid lubricant particles of 2 g was added in 90 g of methyl ethyl ketone, in which 2 g of a polymer dispersant was dissolved. This matting agent dispersion was dispersed by use of an ultrasonic homogenizer (Ultrasonic Generator, produced by Alex Corp., at a frequency of 25 kHz and 600 W) for 30 minutes, whereby a matting agent dispersion was prepared.

[Preparation of Photosensitive Layer Coating Composition]

(Preparation of Photosensitive Layer Coating Composition 1(2))

Aforesaid organic silver salt dispersion A(2) of 1670 g, having been added with the same amount of methyl ethyl ketone, was kept at 18° C. while stirring, and was added with 12.6 g of bis(dimethylacetoamido)dibromate (11% methanol solution) and stirred for 1 hour. Subsequently, the resulting mixture was added with 20.1 g of calcium bromide and was stirred for 30 minutes. Thereafter, the system was cooled to a temperature of 13° C. and was further stirred for 30 minutes. A polyvinyl butyral resin powder (Eslec B-BL-5, produced by Sekisui Chemical Industry Co., Ltd.) of 416 g was added and dissolved in to the mixture while keeping the temperature at 13° C. After confirming the dissolution, 19.8 g of tetrachlorophthalic acid was added, and the following additives were added while further continuing stirring, whereby photosensitive layer coating composition 1(2) was prepared.

| | |
|---|---|
| Phthalazine | 12.4 g |
| Desmodur N3300 (aliphatic isocyanate, produced by Mobey Corp.) | 17.6 g |
| Antifoggant | confer the following |
| Developer solution | confer the following |

<Preparation of Infrared Sensitizing Dye Solution>

Infrared sensitizing dye-1 of 300 mg, 400 mg of infrared sensitizing dye-2, 130 mg of 5-methyl-2-mercapto benzimidazole, 21.5 g of 2-chloro-bezoic acid and 2.5 g of a sensitizing dye solubilizer were dissolved in 135 g of methyl ethyl ketone, whereby an infrared sensitizing dye solution was prepared.

<Preparation of Stabilizer Solution>

A stabilizer of 0.9 g and 0.3 g of potassium acetate were dissolved in 14 g of methanol to prepare a stabilizer solution.

<Preparation of Developer Solution>

A developer of 120 g and 9 g of methylphthalic acid were dissolved in methyl ethyl ketone, which was made up to 1200 g to prepare a developer solution.

<Preparation of Antifoggant Solution>

Tribromomethylsulfonyl pyridine of 11.6 was dissolved in methyl ethyl ketone, which was made up to 180 g to prepare an antifoggant solution.

Infrared Sensitizing Dye-1

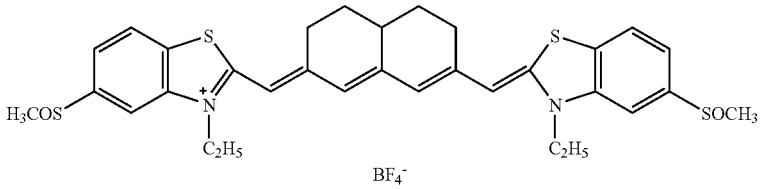

Infrared Sensitizing Dye-2

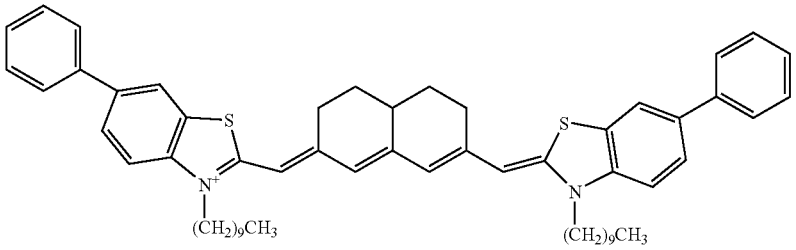

Sensitizing Dye Solubilizer

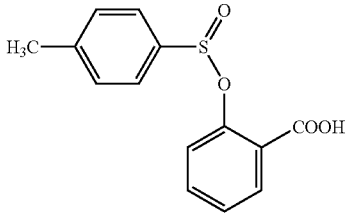

Stabilizer

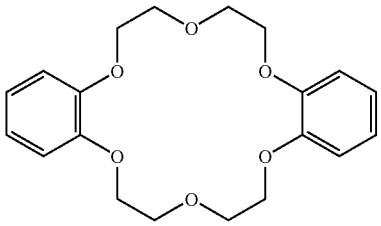

Developer

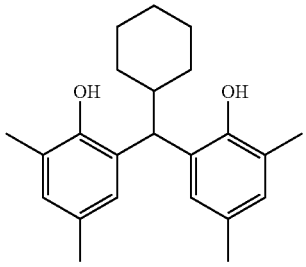

[Preparation of Photosensitive Layer Coating Compositions 2(2)-4(2)]

Aforesaid organic silver salt dispersion B(2) (1670 g), to which 890 g of methyl ethyl ketone were added and kept at 18° C. while stirring, was added with 780 g of polymer dispersed silver halide emulsion prepared above and stirred for 30 minutes. Thereafter, the resulting solution was added with 12.6 g of bis(dimethylacetoamido)dibromate (11% methanol solution) and stirred for 1 hour. Subsequently, 20.1 g of calcium bromide were added and stirred for 30 minutes. Further, the stabilizer solution (described before) and the infrared sensitizer solution (described before) were added and stirred for 1 hour. Thereafter, the system was cooled to a temperature of 13° C. and was further stirred for 30 minutes. A polyvinyl butyral resin powder (Eslec B-BL-5, produced by Sekisui Chemical Industry Co., Ltd.) of 416 g was added and dissolved in to the mixture while keeping the temperature at 13° C. After confirming the dissolution, 19.8 g of tetrachlorophthalic acid was added, and the following additives each were added while further continuing stirring, whereby photosensitive layer coating composition 2(2) was prepared.

Photosensitive layer coating composition 3(2) was prepared in a similar manner to the preparation of above described photosensitive layer coating composition 2(2), except that polymer dispersed silver halide emulsion 3(2) was utilized instead of polymer dispersed silver halide emulsion 2(2).

Further, photosensitive layer coating composition 4(2) was prepared in a similar manner to the preparation of above described photosensitive layer coating composition 3(2), except that polymer dispersed silver halide emulsion 4(2) was utilized instead of polymer dispersed silver halide emulsion 3(2).

| | |
|---|---|
| Phthalazine | 12.4 g |
| Desmodur N3300 (aliphatic isocyanate, produced by Mobey Corp.) | 17.6 g |
| Antifoggant | confer the following |
| Developer solution | confer the following |

[Preparation of Photosensitive Layer Coating composition 5 (2)]

A polyvinyl butyral resin powder (Eslec B-BL-5, produced by Sekisui Chemical Industry Co., Ltd.) of 416 g was added and dissolved in to aforesaid organic silver salt dispersion B (1670 g) kept at 25° C. and after confirming the dissolution, 19.8 g of tetrachlorophthalic acid was added, and the following additives each were added in 15 minutes intervals while further continuing stirring, followed by addition of the following spectrally sensitized polymer dispersed silver halide emulsion 4(2), resulting in preparation of photosensitive layer coating composition 5(2).

| | |
|---|---|
| Phthalazine | 12.4 g |
| Desmodur N3300 (aliphatic isocyanate, produced by Mobey Corp.) | 17.6 g |
| Antifoggant | confer the following |
| Developer solution | confer the following |

(Preparation of Spectrally Sensitized Polymer Dispersed Silver Halide Emulsion 4(2))

Under an inert gas environment (nitrogen 97%), 780 g of above-described polymer dispersed silver halide emulsion 2 was kept at 25° C. while stirring, and was added with 12.6 g of bis(dimethylacetoamido)dibromobromate (11% methanol solution) and stirred for 1 hour. Subsequently, 20.1 g of calcium bromide (11% methanol solution) were added and stirred for 30 minutes. Further, the stabilizer solution (described before) and the infrared sensitizer solution (described before) were added and stirred for 1 hour.

[Preparation of Photosensitive Layer Coating Composition 6(2)]

Photosensitive layer coating composition 6(2) was prepared in a similar manner to preparation of photosensitive layer coating composition 5(2) except that organic silver salt dispersion C(2) was utilized instead of organic silver salt dispersion B(2).

[Preparation of Sample 101(2)]

(Coating of Photosensitive Layer, Surface Protective Layer and Back Layer)

On the photosensitive layer surface side under coat of the above-prepared under-coated support, photosensitive layer coating composition 1(2), so as to make the total silver amount of 1.6 g/m$^2$, and the surface protective layer, so as to make a wet coated amount of 23 g/m$^2$ on the photosensitive layer, were simultaneously coated. Subsequently, on the back surface side under-coat layer of the opposite side, a back layer was coated so as to make a wet coated amount of 4.2 g/m$^2$ Herein, drying processes each were performed at 60° C. for 15 minutes. The sample the both surfaces of which having been coated was heat treated at 79° C. for 10 minutes while being transported, whereby sample 101(2) of a silver salt photothermographic dry imaging material was prepared.

[Preparation of Samples 102(2)-106(2)]

Samples 102(2)-106(2) were prepared in a similar manner to preparation of above-described sample 101(2), except that photosensitive layer coating compositions 2(2)-6(2) were utilized instead of photosensitive layer coating composition 1(2).

<Evaluation of Silver Salt Photothermographic Dry Imaging Material>

With respect to above-prepared samples 101(2)-106(2), various evaluations were performed according to the following methods.

[Exposure and Development]

Each sample prepared above was subjected to exposure from the photosensitive layer coated surface side by means of laser scanning by use of an exposing apparatus, employing a semiconductor laser, which had been made into a lateral multi-mode at 800-820 nm by high frequency accumulation, as a light source through an optical wedge. At this time, an image was formed setting the angle between the exposure plane of a sample and the exposure laser light to 75 degrees. In this case, compared to the case of said angle being set to 90 degrees, obtained was an image exhibiting such as minimum unevenness and surprisingly superior sharpness.

Thereafter, by use of an automatic processor provided with a heating drum and a cooling zone, carried out was thermal development at 120° C. for 13.5 seconds, while bringing the protective layer in contact with the drum surface. In this case, exposure and development were carried out in a room being rehumidified at 23° C. and 50% RH.

[Measurement of Fog Density and Maximum Density]

Density of the obtained silver image comprising a wedge gradation was measured by use of a densitometer PDA-65, manufactured by Konicaminolta MG Corp., and formed was a characteristic curve constituted of silver image density (D) as ordinate and logarithm (log E) of exposure (E) as abscissa.

In this characteristic curve, determined was the sensitivity, being defined as a reciprocal of the ratio of an exposure quantity necessary to provide a density higher by 1.0 than the minimum density (fog density). Further, the minimum density (fog density) and the maximum density were determined. Herein, the sensitivity and the maximum density were determined, as relative values when the sensitivity and the maximum density of sample 101 were set to 100.

[Dispersibility Evaluation in Coated Layer]

With respect to each sample, according to the aforesaid method, visually evaluated was dispersibility of photosensitive silver halide grains having a grain size, which is measured from an exposure direction of a photosensitive material, of not less than 0.005 μm and not more than 0.1 μm, based on the image of a transmission type electronmicroscope (hereinafter, referred to as a TEM).

(Evaluation of Dispersibility)

With respect to each sample, an ultra-thin slice having a thickness of 0.1-0.2 μm was prepared by use of a diamond knife, and this ultra-thin slice was held on a copper mesh to be transferred on a carbon film, which had been made hydrophilic by grow discharge, followed by being observed through a TEM in a light range of vision and at a magnification of 5,000-40,000 while being cooled at not higher than −130° C. by liquid nitrogen and images were quickly recorded on a CCD camera. A very thin colodion organic film was utilized as a carbon film, and an acceleration voltage of a TEM was set to 150 kV. The recorded TEM images were visually observed to evaluate dispersibilty according to the following criteria.

A: Each silver halide grain is uniformly dispersed without generation of aggregation.

B: With a part of silver halide grains, slight aggregation is observed, however, as a whole, grains are uniformly dispersed.

C: Considerable silver halide grains cause aggregation, and the dispersion state is non-uniform.

[Evaluation of Humidity Dependence]

With respect each sample, after having been rehumidified under an environment of 23° C. and 80% RH for 3 days, exposure and development were performed in a similar manner to the above measurement of the fog density and the maximum density. Fog density of each sample was measured, which was defined as a measure of humidity dependence.

The obtained results in the above manner are shown in Table 2(2).

TABLE 2(2)

| Sample No. | Polymer for dispersion of silver halide grains | Powder organic silver salt No. | *1 | Photosensitive layer coating composition No. | *2 | Evaluation result: Dispersibility in a coated film | Minimum density | Relative sensitivity | Maximum density | Minimum density after humidity conditioning | Remarks |
|---|---|---|---|---|---|---|---|---|---|---|---|
| 101(2) | — | A(2) | 43 | 1(2) | Before spectral sensitization of AgX | B | 0.19 | 100 | 3.5 | 0.22 | Comp. |
| 102(2) | A(2) | B(2) | 43 | 2(2) | Before spectral sensitization of AgX | A | 0.18 | 115 | 3.7 | 0.18 | Inv. |
| 103(2) | B(2) | B(2) | 43 | 3(2) | Before spectral sensitization of AgX | A | 0.18 | 108 | 3.6 | 0.18 | Inv. |
| 104(2) | C(2) | B(2) | 43 | 4(2) | Before spectral sensitization of AgX | A | 0.18 | 112 | 3.7 | 0.18 | Inv. |
| 105(2) | A(2) | B(2) | 43 | 5(2) | After spectral sensitization of AgX | A | 0.16 | 120 | 4.0 | 0.16 | Inv. |
| 106(2) | A(2) | C(2) | 85 | 6(2) | After spectral sensitization of AgX | A | 0.16 | 129 | 4.1 | 0.16 | Inv. |

Note:
*1: Silver behenate content (mol %)
*2: Mixing timing of silver halide grains and aliphatic acid salt of silver
*3: AgX: Silver halide grains It is clear from the results described in Table 2(2) that the samples comprised of a constitution of this invention exhibit high sensitivity and high maximum density and low minimum density as well as minimum influence of humidity compared to the comparative examples, that is, are provided with suitable image characteristics as diagnostic images.

What is claimed is:

1. A photothermographic material comprising a micro-particle dispersion dispersed in an organic solvent having a water content of not more than 10%, the micro-particle dispersion having a hydrophobic protective colloid and manufactured by a method comprising the steps of:

(a) dispersing micro-particles in a hydrophilic dispersant to form a hydrophilic micro-particle dispersion having the hydrophilic dispersant as a protective colloid, and (b) adding a dispersant to the hydrophilic micro-particle dispersion, the dispersant having a functional group capable of ion bonding with a hydrophilic group of the hydrophilic dispersant.

2. A photothermographic material comprising a support having thereon a layer containing a photosensitive emulsion, photo-insensitive organic silver salt grains and a binder, wherein the photosensitive emulsion comprises a micro-particle dispersion dispersed in an organic solvent having a water content of not more than 10% and having a hydrophobic protective colloid, wherein the micro-particles are silver halide grains, and wherein the micro-particle dispersion is manufactured by a method comprising the steps of:

(a) dispersing micro-particles in a hydrophilic dispersant to form a hydrophilic micro-particle dispersion having the hydrophilic dispersant as a protective colloid, and (b) adding a dispersant to the hydrophilic micro-particle dispersion, the dispersant having a functional group capable of ion bonding with a hydrophilic group of the hydrophilic dispersant.

3. The photothermographic material of claim 2, wherein the photosensitive emulsion is prepared by addition of the micro-particle dispersion having a hydrophobic protective colloid to the photo-insensitive silver salt grains, the micro-particle dispersion being manufactured by the method comprising the steps of:

(a) dispersing micro-particles in a hydrophilic dispersant to form a hydrophilic micro-particle dispersion having the hydrophilic dispersant as a protective colloid, and (b) adding a dispersant to the hydrophilic micro-particle dispersion, the dispersant having a functional group capable of ion bonding with a hydrophilic group of the hydrophilic dispersant.

4. The photothermographic material of claim 1, wherein the organic solvent may be methyl ethyl ketone or a combination of methyl ethyl ketone and at least one other organic solvent.

* * * * *